US006386700B1

(12) United States Patent
Akahira

(10) Patent No.: US 6,386,700 B1
(45) Date of Patent: May 14, 2002

(54) COLOR-FILTER MANUFACTURING METHOD, COLOR FILTER, DISPLAY DEVICE, AND APPARATUS HAVING THE DISPLAY DEVICE

(75) Inventor: Makoto Akahira, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/123,427

(22) Filed: Jul. 28, 1998

(30) Foreign Application Priority Data

Jul. 31, 1997 (JP) ..... 9-206638

(51) Int. Cl.[7] ..... B41J 3/407
(52) U.S. Cl. ..... 347/106
(58) Field of Search ..... 347/41, 12, 13, 347/106, 107

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 4,920,355 A | * | 4/1990 | Katerberg | 347/41 |

FOREIGN PATENT DOCUMENTS

| | | |
|---|---|---|
| EP | 0 791 841 | 8/1997 |
| JP | 54-56847 | 5/1979 |
| JP | 59-75205 | 4/1984 |
| JP | 59-123670 | 7/1984 |
| JP | 59-138461 | 8/1984 |
| JP | 60-71260 | 4/1985 |
| JP | 63-235901 | 9/1988 |
| JP | 63-294503 | 12/1988 |
| JP | 1-217320 | 8/1989 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A color-filter manufacturing method which can greatly reduce density unevenness among pixels of a color filter. To make the amount of ink discharged for each pixel constant, a theoretical ink discharge pitch D is calculated for each of ink-discharge nozzles in accordance with an amount of ink discharged per single discharge of each of the plurality of ink-discharge nozzles, and ink is discharged such that, assuming a minimum moving pitch of an amount of relative movement of the ink-jet head in the scanning direction is d, in a case where a value kD (k is an integer equal to or larger than 0) corresponding to a theoretical discharge position of an n-th ink dot discharged along the scanning direction coincides with nd (n is an integer equal to or larger than 0), ink is discharged at a position satisfying kD=nd, and in a case where kD takes a value between nd and (n+1)d, ink is discharged at a position corresponding to nd or a position corresponding to (n+1)d.

10 Claims, 19 Drawing Sheets

UNEVENNESS IN AMOUNT OF INK DISCHARGED1

COLOR-FILTER MANUFACTURING METHOD, COLOR FILTER, DISPLAY DEVICE, AND APPARATUS HAVING THE DISPLAY DEVICE

BACKGROUND OF THE INVENTION

The present invention relates to a color-filter manufacturing method for manufacturing a color filter by forming a colored layer with the use of an ink-jet head, a color filter manufactured by the manufacturing method, a display device including the color filter, and an apparatus having the display device.

With recent advances in personal computers, especially portable personal computers, the demand for liquid crystal displays has risen, especially color liquid crystal displays. However, in order to further popularize the use of liquid crystal displays, a reduction of cost must be achieved. Especially, it is required to reduce the cost of a color filter which constitutes a large proportion of the total cost. Various methods have been tried to satisfy the required characteristics of color filters while meeting the above requirements. However, no method capable of satisfying all the requirements has been established. The respective methods will be described below.

The first method is a pigment dispersion method. In this method, a pigment-dispersed photosensitive resin layer is formed on a substrate and patterned into a single-color pattern. This process is repeated three times to obtain R, G, and B color filter layers.

The second method is a dyeing method. In the dyeing method, a water-soluble polymer material as a dyeable material is applied onto a glass substrate, and the coating is patterned into a desired shape by a photolithographic process. The obtained pattern is dipped in a dye bath to obtain a colored pattern. This process is repeated three times to form R, G, and B color filter layers.

The third method is an electrodeposition method. In this method, a transparent electrode is patterned on a substrate, and the resultant structure is dipped in an electrodeposition coating fluid containing a pigment, a resin, an electrolyte, and the like to be colored in the first color by electrodeposition. This process is repeated three times to form R, G, and B color filter layers. Finally, these layers are calcined.

The fourth method is a print method. In this method, a pigment is dispersed in a thermosetting resin, a print operation is performed three times to form R, G, and B coatings separately, and the resins are thermoset, thereby forming colored layers. In all of the above methods, a protective layer is generally formed on the colored layers.

The point common to these methods is that the same process must be repeated three times to obtain layers colored in three colors, i.e., R, G, and B. This causes an increase in cost. In addition, as the number of processes increases, the yield decreases. In the electrodeposition method, limitations are imposed on pattern shapes which can be formed. For this reason, with the existing techniques, it is difficult to apply this method to TFTs. In the print method, a pattern with a fine pitch is difficult to form because of poor resolution and poor evenness.

In order to eliminate these drawbacks, methods of manufacturing color filters by an ink-jet system are disclosed in Japanese Patent Laid-Open Nos. 59-75205, 63-235901 and 1-217320. According to these methods, inks having three colors of pigment R (red), G (green) and B (blue) are discharged on a light-transmitting substrate by ink-jet method and each ink is dried to form a colored image portion. Such ink-jet method enables forming of pixels colored in R, G and B, all at once. Therefore, the manufacturing process can be greatly simplified and large cost-down effect can be attained.

In the ink-jet printing method, an ink-jet head having a plurality of ink-discharge nozzles is scanned over a substrate, and performs coloring of a plurality of pixel columns arrayed in the direction orthogonal to the scanning direction. However, when there is fluctuation in the amount of ink discharged by each of the nozzles of the ink-jet head, a problem arises in that density unevenness occurs among pixel columns arrayed in the direction orthogonal to the scanning direction.

SUMMARY OF THE INVENTION

The present invention has been made in consideration of the above problem, and the object of the present invention is to provide a color-filter manufacturing method which can greatly reduce density unevenness among pixels of a color filter.

Another object of the present invention is to provide a color filter manufactured by the above manufacturing method, a display device including the color filter, and an apparatus having the display device.

In order to solve the above-described problems and attain the above objects, the color-filter manufacturing method according to the first aspect of the present invention is a color-filter manufacturing method of coloring each pixel of a color-subject material by scanning an ink-jet head, having a plurality of ink-discharge nozzles in a direction substantially orthogonal to a scanning direction, with relative to the color-subject material, and discharging ink to the color-subject material by the plurality of ink-discharge nozzles, comprising the steps of: calculating a theoretical ink discharge pitch D for each of the ink-discharge nozzles in accordance with an amount of ink discharged per single discharge of each of the plurality of ink-discharge nozzles, in order to make an amount of ink discharged for each pixel constant; and discharging ink such that, assuming a minimum moving pitch of an amount of relative movement of the ink-jet head in the scanning direction is d, in a case where a value kD (k is an integer equal to or larger than 0) corresponding to a theoretical discharge position of an n-th ink dot discharged along the scanning direction coincides with nd (n is an integer equal to or larger than 0), ink is discharged at a position substantially satisfying kD=nd, and in a case where kD takes a value between nd and (n+1)d, ink is discharged at a position corresponding to nd or a position corresponding to (n+1)d.

Furthermore, a color filter according to the first aspect of the present invention is a color filter manufactured by coloring each pixel of a color-subject material by scanning an ink-jet head, having a plurality of ink-discharge nozzles in a direction substantially orthogonal to a scanning direction, with relative to the color-subject material, and discharging ink to the color-subject material by the plurality of ink-discharge nozzles, the color filter manufactured by the steps of: calculating a theoretical ink discharge pitch D for each of the ink-discharge nozzles in accordance with an amount of ink discharged per single discharge of each of the plurality of ink-discharge nozzles, in order to make an amount of ink discharged for each pixel constant; and discharging ink such that, assuming a minimum moving pitch of an amount of relative movement of the ink-jet head in the scanning direction is d, in a case where a value kD (k is an integer equal to or larger than 0) corresponding to a theoretical discharge position of an n-th ink dot discharged along the scanning direction coincides with nd (n is an integer equal to or larger than 0), ink is discharged at a position substantially satisfying kD=nd, and in a case where kD takes a value between nd and (n+1)d, ink is discharged at a position corresponding to nd or a position corresponding to (n+1)d.

Furthermore, a display apparatus according to the first aspect of the present invention is a display device including a color filter manufactured by coloring each pixel of a color-subject material by scanning an ink-jet head, having a plurality of ink-discharge nozzles in a direction substantially orthogonal to a scanning direction, with relative to the color-subject material, and discharging ink to the color-subject material by the plurality of ink-discharge nozzles, the display device integrally comprising: light-amount changing means for enabling to change an amount of light; and a color filter manufactured by the steps of: calculating a theoretical ink discharge pitch D for each of the ink-discharge nozzles in accordance with an amount of ink discharged per single discharge of each of the plurality of ink-discharge nozzles, in order to make an amount of ink discharged for each pixel constant; and discharging ink such that, assuming a minimum moving pitch of an amount of relative movement of the ink-jet head in the scanning direction is d, in a case where a value kD (k is an integer equal to or larger than 0) corresponding to a theoretical discharge position of an n-th ink dot discharged along the scanning direction coincides with nd (n is an integer equal to or larger than 0), ink is discharged at a position substantially satisfying kd=nd, and in a case where kD takes a value between nd and (n+1)d, ink is discharged at a position corresponding to nd or a position corresponding to (n+1)d.

Still further, an apparatus according to the first aspect of the present invention is an apparatus having a display device which includes a color filter manufactured by coloring each pixel of a color-subject material by scanning an ink-jet head, having a plurality of ink-discharge nozzles in a direction substantially orthogonal to a scanning direction, with relative to the color-subject material, and discharging ink to the color-subject material by the plurality of ink-discharge nozzles, the apparatus comprising image-signal supplying means for supplying an image signal to the display device, the display device integrally comprising: light-amount changing means for enabling to change an amount of light; and a color filter manufactured by the steps of: calculating a theoretical ink discharge pitch D for each of the ink-discharge nozzles in accordance with an amount of ink discharged per single discharge of each of the plurality of ink-discharge nozzles, in order to make an amount of ink discharged for each pixel constant; and discharging ink such that, assuming a minimum moving pitch of an amount of relative movement of the ink-jet head in the scanning direction is d, in a case where a value kD (k is an integer equal to or larger than 0) corresponding to a theoretical discharge position of an n-th ink dot discharged along the scanning direction coincides with nd (n is an integer equal to or larger than 0), ink is discharged at a position substantially satisfying kD=nd, and in a case where kD takes a value between nd and (n+1)d, ink is discharged at a position corresponding to nd or a position corresponding to (n+1)d.

Moreover, in order to solve the above-described problems and attain the above objects, the color-filter manufacturing method according to the second aspect of the present invention is a color-filter manufacturing method of coloring each pixel of a color-subject material by scanning an ink-jet head, having a plurality of ink-discharge nozzles in a direction substantially orthogonal to a scanning direction, with relative to the color-subject material, and discharging ink to the color-subject material by the plurality of ink-discharge nozzles, comprising the steps of: calculating a theoretical ink discharge pitch for each of the ink-discharge nozzles in accordance with an amount of ink discharged per single discharge of each of the plurality of ink-discharge nozzles, in order to make an amount of ink discharged for each pixel constant; and discharging ink such that, in a case where an integer multiple of the theoretical ink discharge pitch coincides with an integer multiple of a minimum moving pitch of an amount of relative movement of the ink-jet head in the scanning direction, ink is discharged at a position corresponding to the integer multiple of the minimum moving pitch, and in a case where an integer multiple of the theoretical ink discharge pitch does not coincide with an integer multiple of the minimum moving pitch of the amount of relative movement of the ink-jet head in the scanning direction, ink is discharged at a position corresponding to a closest integer multiple of the minimum moving pitch.

Furthermore, a color filter according to the second aspect of the present invention is a color filter manufactured by coloring each pixel of a color-subject material by scanning an ink-jet head, having a plurality of ink-discharge nozzles in a direction substantially orthogonal to a scanning direction, with relative to the color-subject material, and discharging ink to the color-subject material by the plurality of ink-discharge nozzles, the color filter manufactured by the steps of:

calculating a theoretical ink discharge pitch for each of the ink-discharge nozzles in accordance with an amount of ink discharged per single discharge of each of the plurality of ink-discharge nozzles, in order to make an amount of ink discharged for each pixel constant; and discharging ink such that, in a case where an integer multiple of the theoretical ink discharge pitch coincides with an integer multiple of a minimum moving pitch of an amount of relative movement of the ink-jet head in the scanning direction, ink is discharged at a position corresponding to the integer multiple of the minimum moving pitch, and in a case where an integer multiple of the theoretical ink discharge pitch does not coincide with an integer multiple of the minimum moving pitch of the amount of relative movement of the ink-jet head in the scanning direction, ink is discharged at a position corresponding to a closest integer multiple of the minimum moving pitch.

Furthermore, a display apparatus according to the second aspect of the present invention is a display device including a color filter manufactured by coloring each pixel of a color-subject material by scanning an ink-jet head, having a plurality of ink-discharge nozzles in a direction substantially orthogonal to a scanning direction, with relative to the color-subject material, and discharging ink to the color-subject material by the plurality of ink-discharge nozzles, the display device integrally comprising: light-amount changing means for enabling to change an amount of light; and a color filter manufactured by the steps of:

calculating a theoretical ink discharge pitch for each of the ink-discharge nozzles in accordance with an amount of ink discharged per single discharge of each of the plurality of ink-discharge nozzles, in order to make an amount of ink discharged for each pixel constant; and discharging ink such that, in a case where an integer multiple of the theoretical ink discharge pitch coincides with an integer multiple of a minimum moving pitch of an amount of relative movement of the ink-jet head in the scanning direction, ink is discharged at a position corresponding to the integer multiple of the minimum moving pitch, and in a case where an integer multiple of the theoretical ink discharge pitch does not coincide with an integer multiple of the minimum moving pitch of the amount of relative movement of the ink-jet head in the scanning direction, ink is discharged at a position corresponding to a closest integer multiple of the minimum moving pitch.

Still further, an apparatus according to the second aspect of the present invention is an apparatus having a display device which includes a color filter manufactured by coloring each pixel of a color-subject material by scanning an ink-jet head, having a plurality of ink-discharge nozzles in a direction substantially orthogonal to a scanning direction, with relative to the color-subject material, and discharging ink to the color-subject material by the plurality of ink-discharge nozzles, the apparatus comprising image-signal supplying means for supplying an image signal to the display device, the display device integrally comprising: light-amount changing means for enabling to change an amount of light; and a color filter manufactured by the steps of: calculating a theoretical ink discharge pitch D for each of the ink-discharge nozzles in accordance with an amount of ink discharged per single discharge of each of the plurality of ink-discharge nozzles, in order to make an amount of ink discharged for each pixel constant; and discharging ink such that, in a case where an integer multiple of the theoretical ink discharge pitch coincides with an integer multiple of a minimum moving pitch of an amount of relative movement of the ink-jet head in the scanning direction, ink is discharged at a position corresponding to the integer multiple of the minimum moving pitch, and in a case where an integer multiple of the theoretical ink discharge pitch does not coincide with an integer multiple of the minimum moving pitch of the amount of relative movement of the ink-jet head in the scanning direction, ink is discharged at a position corresponding to a closest integer multiple of the minimum moving pitch.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follows the description for determining the scope of the invention.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENT

Preferred embodiment of the present invention will be described in detail in accordance with the accompanying drawings.

Note that a color filter defined in the present embodiment includes a coloring portion and a color-subject material, and in the coloring filter, inputted light is outputted with a changed characteristic.

Figure 1:
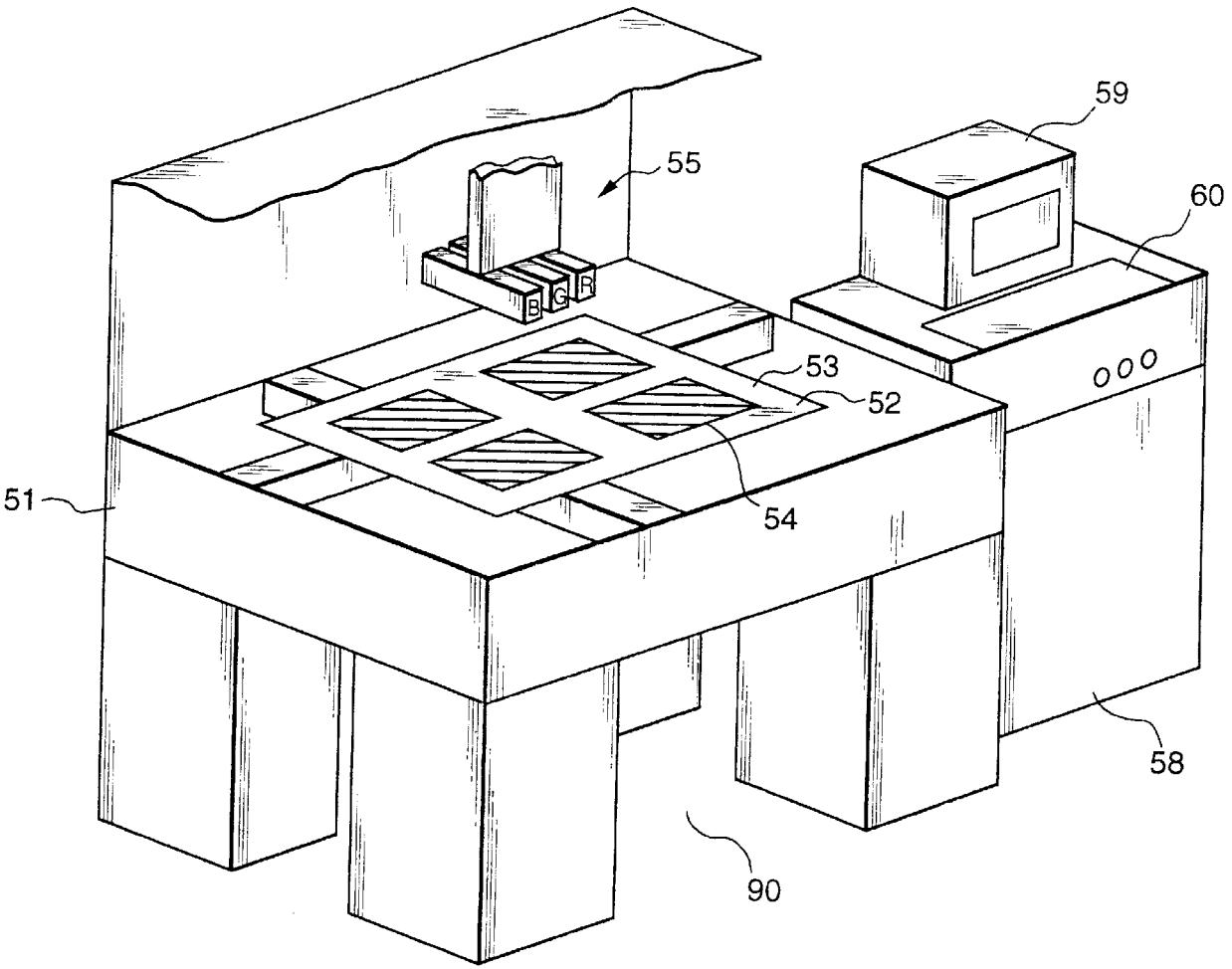
FIG. 1 is a perspective view showing a construction of a color-filter manufacturing apparatus as an embodiment of the present invention.

FIG. 1 is a perspective view showing a construction of a color-filter manufacturing apparatus as an embodiment of the present invention.

In FIG. 1, reference numeral 51 denotes a platform of the apparatus; 52, an XY θ stage provided on the platform 51; 53, a color-filter substrate set on the XY θ stage 52; 54, a color filter formed on the color-filter substrate 53; 55, a head unit including R (red), G (green) and B (blue) ink-jet heads for coloring the color filter 54; 58, a controller which controls the overall operation of a color-filter manufacturing apparatus 90; 59, a teaching pendant (personal computer) as a display unit of the controller 58; and 60, a keyboard as an operation unit of the teaching pendant 59.

Figure 2:
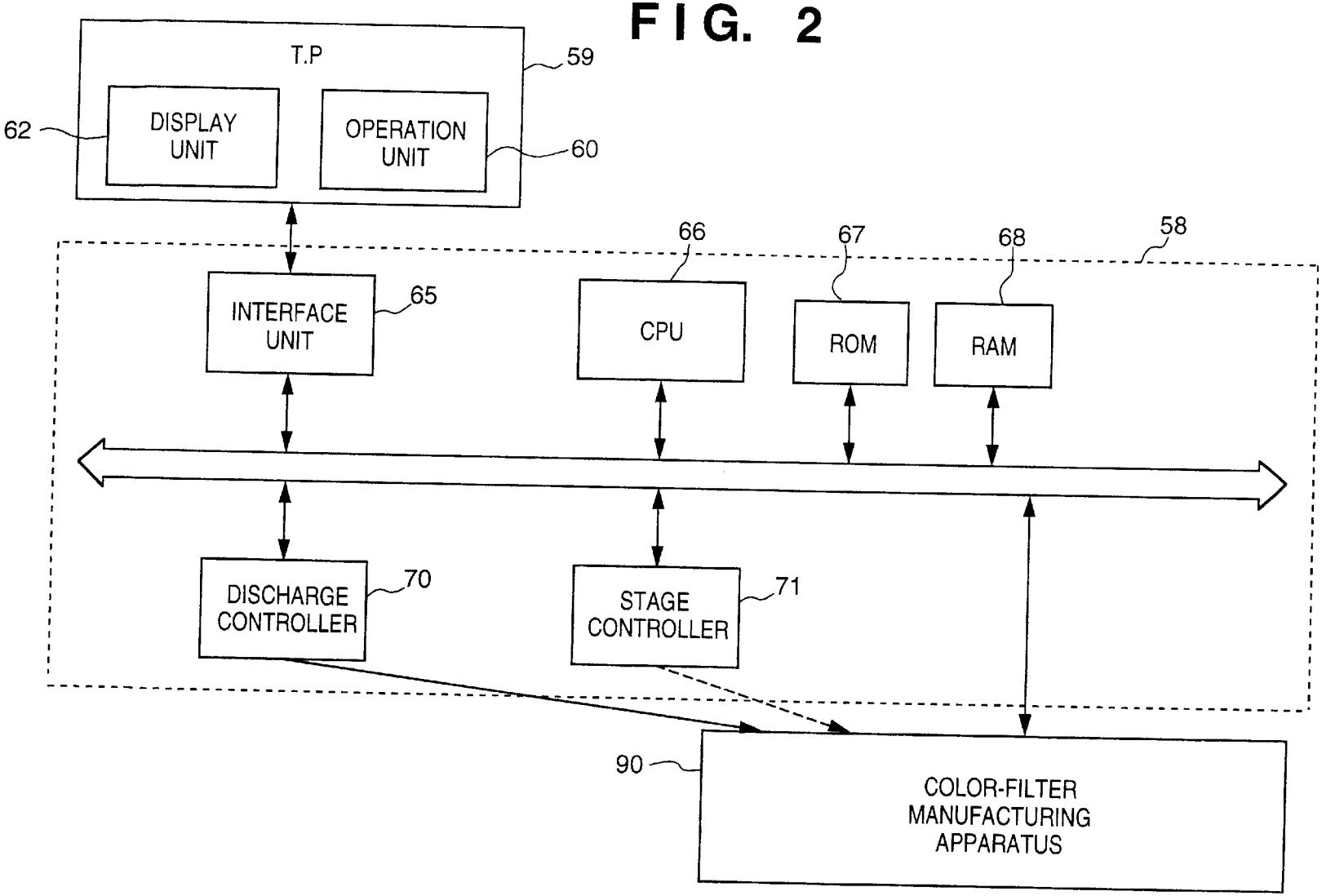
FIG. 2 is a block diagram showing the construction of a controller which controls the operation of the color-filter manufacturing apparatus.

FIG. 2 is a block diagram showing the construction of a controller which controls the operation of the color-filter manufacturing apparatus 90. In FIG. 2, the teaching pendant 59 serves as input/output means of the controller 58. Numeral 62 denotes a display unit which displays information on the progress of manufacturing process, presence/absence of abnormality of the ink-jet head and the like. The keyboard 60 serves as an operation unit for instructing the operation and the like of the color-filter manufacturing apparatus 90.

Reference numeral 58 denotes a controller which controls the overall operation of the color-filter manufacturing apparatus 90; 65, an interface unit for receiving/sending data with respect to the teaching pendant 59; 66, a CPU which controls the color-filter manufacturing apparatus 90; 67, a ROM in which control programs for operating the CPU 66 are stored; 68, a RAM in which production information and the like are stored; 70, a discharge controller which controls ink discharge to respective pixels of a color filter; 71, a stage controller which controls the operation of the XY θ stage 52. The color-filter manufacturing apparatus 90 is connected to the controller 58, and operates in accordance with instructions from the controller 58.

Figure 3:
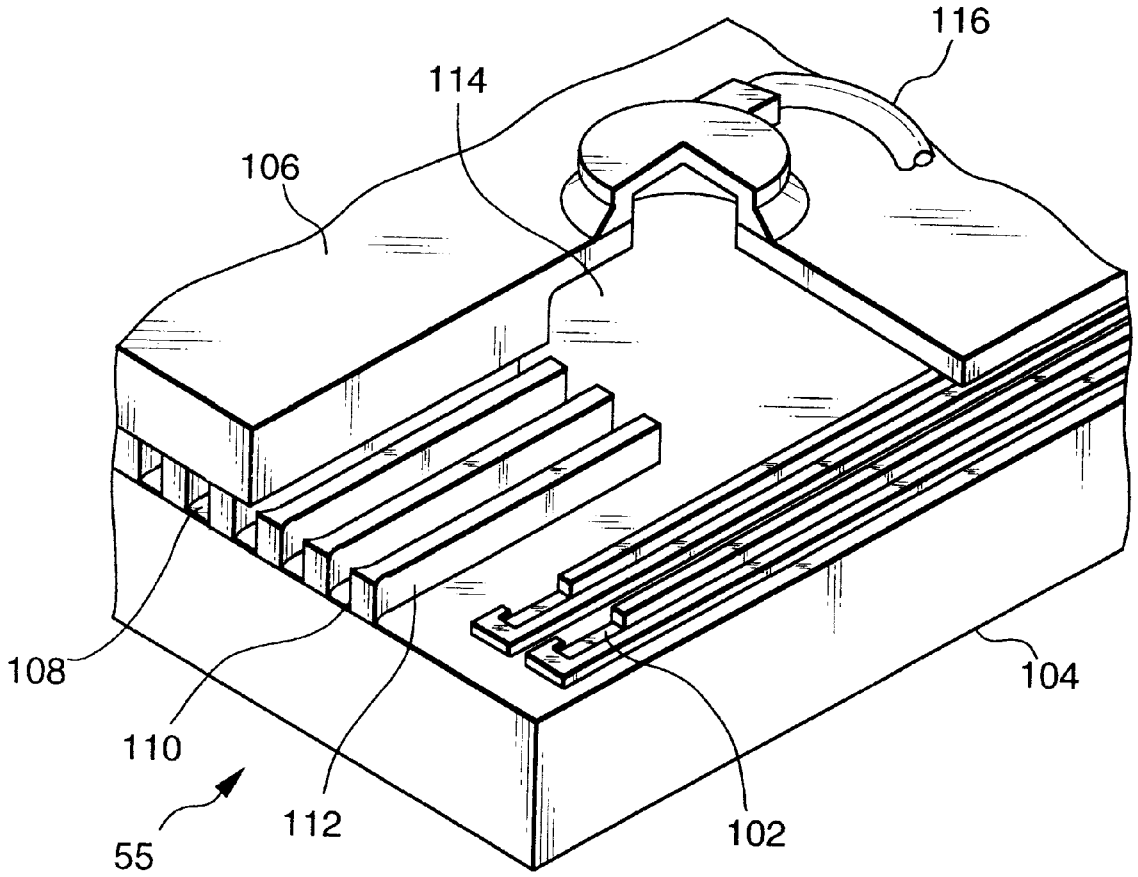
FIG. 3 is a perspective view showing the structure of an ink-jet head used in the color-filter manufacturing apparatus.

FIG. 3 is a perspective view showing the structure of the ink-jet head 55 used in the above color-filter manufacturing apparatus 90. In FIG. 1, the three ink-jet heads IJH are provided in correspondence to the three, R, G and B colors, however, as the three heads have the same structure, FIG. 3 shows the structure of one of these heads.

In FIG. 3, the ink-jet head IJH mainly comprises a heater board 104 as a base plate, a plurality of heaters 102 formed on the heater board 104, and a top plate 106 placed on the heater board 104. A plurality of discharge orifices 108 are formed on the top plate 106, and tunnel-like liquid channels 110 connected to the discharge orifices 108 are formed at the rear of the discharge orifices 108. The respective liquid channels 110 are separated from each other by partition walls 112. The liquid channels 110 are connected to a common ink chamber 114 at the rear of the liquid channels. Ink is supplied to the ink chamber 114 via an ink supply port 116, and the ink is supplied from the ink chamber 114 to the respective liquid channels 110.

The heater board 104 and the top plate 106 are assembled such that the respective heaters 102 are positioned corresponding to the respective liquid channels 110, as shown in FIG. 3. Although FIG. 3 only shows two heaters 102, the heaters 102 are respectively provided in correspondence to the respective liquid channels 110. In the assembled state as shown in FIG. 3, when a predetermined drive pulse is applied to the heaters 102, the ink on the heaters 102 is boiled to form bubbles, and the ink is pressed due to volume expansion of the bubbles and discharged from the discharge orifices 108. Accordingly, the size of the bubbles can be controlled by controlling the drive pulse, e.g., the level of electric power, applied to the heaters 102. Thus, the volume of the ink discharged from the discharge orifices can be freely controlled.

Figure 4:
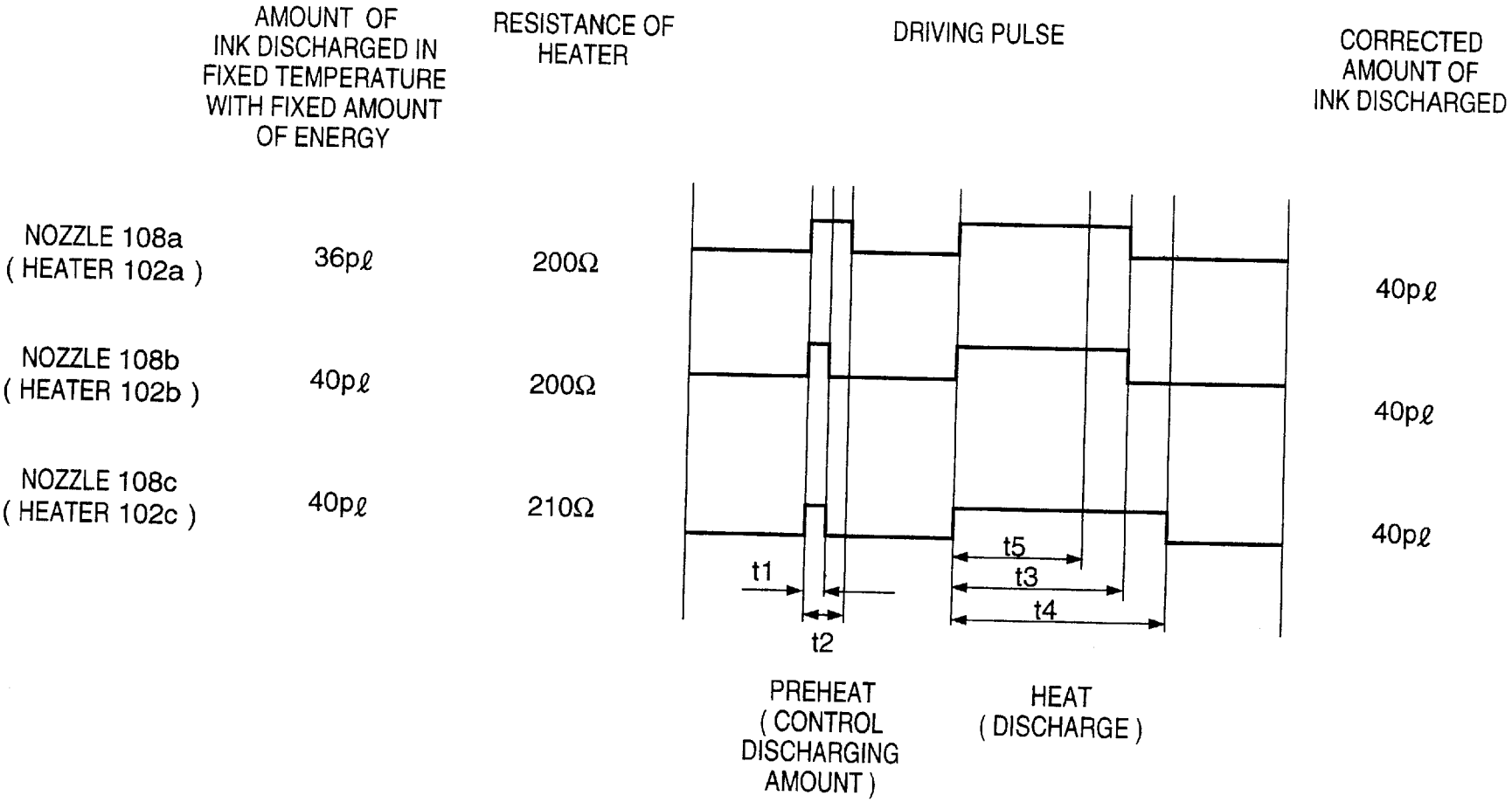
FIG. 4 is a timing chart for explaining a method of controlling the amount of ink discharge by changing power supplied to each heater.

FIG. 4 is a timing chart for explaining a method of controlling the amount of ink discharge by changing power supplied to each heater in this manner.

In the present embodiment, two types of constant-voltage pulses are applied to each heater 102 to adjust the amount of ink discharged. The two pulses are a preheat pulse and a main heat pulse (to be simply referred to as a heat pulse hereinafter), as shown in FIG. 4. The preheat pulse is a pulse for heating ink to a predetermined temperature before the ink is actually discharged. The pulsewidth of this pulse is set to be smaller than a minimum pulsewidth t5 required to discharge the ink. Therefore, the ink is not discharged by this preheat pulse. The preheat pulse is applied to each heater 102 to increase the initial temperature of the ink to a predetermined temperature in advance so as to always make the amount of ink discharged constant when a constant heat pulse is applied to the heater 102 afterward. In contrast to this, the temperature of the ink may be adjusted in advance by adjusting the width of a preheat pulse. In this case, for the same heat pulse, the amount of ink discharged can be changed. In addition, by heating ink before application of a heat pulse, the start time required to discharge the ink upon application of the heat pulse can be shortened to improve the responsibility.

The heat pulse is a pulse for actually discharging the ink. The pulsewidth of the heat pulse is set to be larger than the minimum pulsewidth t5 required to discharge the ink. Energy generated by each heater 102 is proportional to the width (application time) of a heat pulse. Therefore, variations in the characteristics of the heaters 102 can be adjusted by adjusting the width of each heat pulse.

Note that the amount of ink discharged can also be adjusted by adjusting the interval between a preheat pulse and a heat pulse to control the dispersed state of heat upon application of the preheat pulse.

As is apparent from the above description, the amount of ink discharged can be controlled both by adjusting the application time of a preheat pulse and by adjusting the interval between application of a preheat pulse and that of a heat pulse. Therefore, by adjusting the application time of a preheat pulse or the interval between application of a preheat pulse and that of a heat pulse as needed, the amount of ink discharged or the responsibility of discharging of the ink with respect to an applied pulse can be arbitrarily adjusted.

Such adjustment of the amount of ink discharged will be described in detail next.

Assume that ink is discharged in different amounts from discharging openings (nozzles) 108*a*, 108*b*, and 108*c* upon application of the same voltage pulse, as shown in FIG. 4. More specifically, assume that when a voltage having a predetermined pulsewidth is applied at a predetermined temperature, the amount of ink discharged from the nozzle 108*a* is 36 pl (pico-liters); the amount of ink discharged from the nozzle 108*b*, 40 pl; and the amount of ink discharged from the nozzle 108*c*, 40 pl, and the resistance of heaters 102*a* and 102*b* corresponding to the nozzles 108*a* and 108*b* is 200 Ω, and the resistance of a heater 102*c* corresponding to the nozzle 108*c* is 210 Ω. Assume that the amounts of ink discharged from the nozzles 108*a*, 108*b*, and 108*c* are to be adjusted to 40 pl.

The widths of a preheat pulse and a heat pulse may be altered to adjust the amounts of ink, discharged from the nozzles 108*a*, 108*b*, and 108*c*, to the same amount. Various combinations of the widths of preheat pulses and heat pulses are conceivable. In this case, the amounts of energy generated by heat pulses are made equal for the three nozzles, and the amounts of ink discharged are adjusted by adjusting the widths of preheat pulses.

Since the heaters 102*a* and 102*b* for the nozzles 108*a* and 108*b* have the same resistance, i.e., 200 Ω, the amounts of energy generated by heat pulses can be made equal by applying voltage pulses having the same width to the heaters 102*a* and 102*b*. In this case, the width of each voltage pulse is set to be t3 which is larger than the width t5. An ink is discharged in different amounts, i.e., 36 pl and 40 pl, from the nozzles 108*a* and 108*b* upon application of identical heat pulses. In order to increase the amount of ink discharged from the nozzle 108*a*, a preheat pulse having a width t2 larger than a width t1 of a preheat pulse applied to the heater 102*b* is applied to the heater 102*a*. With this operation, the amounts of ink discharged from the heaters 108*a* and 108*b* can be adjusted to 40 pl.

The heater 102*c* for the nozzle 108*c* has a resistance of 210 Ω, which is higher than the resistance of the two remaining heaters 102*a* and 102*b*. For this reason, in order to cause the heater 102*c* to generate the same amount of energy as that generated by the two remaining heaters, the width of a heat pulse must be set to be larger than that of the above heat pulse. In this case, therefore, the width of the heat pulse is set to be t4 which is larger than the width t3. Since the amounts of ink discharged from the nozzles 108*b* and 108*c* upon application of a predetermined energy are the same, the width of a preheat pulse required is equal to that of a preheat pulse applied to the heater 102*b*. That is, a preheat pulse having the width t1 is applied to the heater 102*c*.

In the above manner, the same amount of ink can be discharged from the nozzles 108*a*, 108*b*, and 108*c* which discharge an ink in different amounts upon application of a predetermined pulse. In addition, the amounts of ink discharged may be intentionally made to differ from each other. Note that preheat pulses are used to reduce variations in the discharging operation of each nozzle.

FIGS. 5A to 5F show the process of manufacturing a color filter.

Figure 5A:
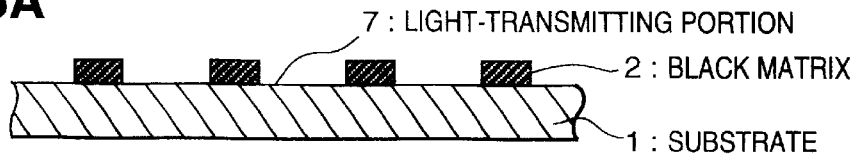
FIGS. 5A to 5F show the process of manufacturing a color filter.
Figure 5B:
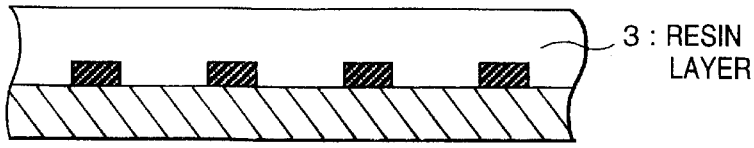
Figure 5C:
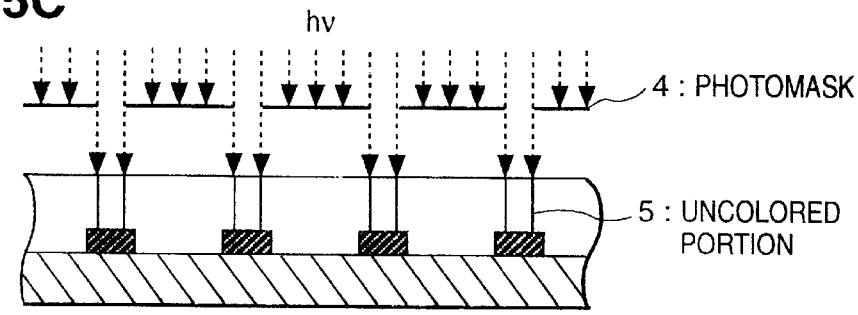
Figure 5D:
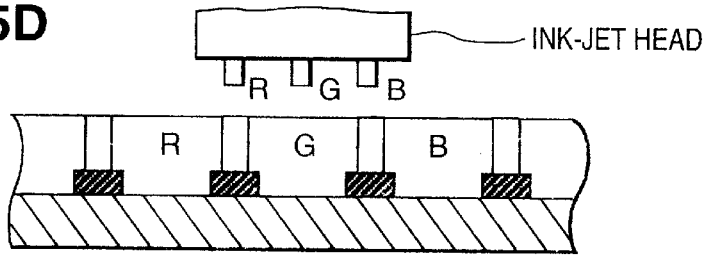
Figure 5E:
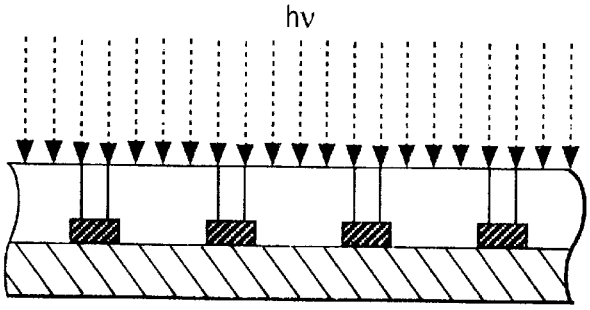

FIG. 5A shows the glass substrate 1 having a light-transmitting portion 7 and a black matrix 2 as a light-shielding portion. First, resin composition, which is set by irradiation of light or a combination of irradiation of light and heating, and which has ink acceptability, is coated on the substrate 1 on which the black matrix 2 is formed, and prebaking is performed in accordance with necessity to form a resin layer 3 (FIG. 5B). The resin layer 3 can be formed by various coating methods such as spin coating, roll coating, bar coating, spray coating and dip coating, and the formation of the resin layer 3 is not limited to any specific method.

Next, a part of the resin layer 3 is set to form a non-absorptive portion 5 (uncolored portion) by performing pattern exposure by utilizing a photomask 4, on the resin layer in advance at a portion light-shielded by the black matrix 2 (FIG. 5C), and a plurality of cells are formed as an ink receiving portion. Then, the plurality of cells are colored all at once with respective R, G and B colors by the ink-jet head (FIG. 5D), and the ink is dried in accordance with necessity.

In the pattern exposure, a photomask 4 having openings for curing the light-shielded portions by the black matrix 2 is employed. At this time, to prevent occurrence of uncolored portion at a portion which abuts on the black matrix 2, it is necessary to apply a relatively large amount of ink to such portion. For this purpose, the photomask 4 have openings greater than the width (light-shielding width) of the black matrix 2.

As the ink used for coloring, dyes and pigments are both available, and further, both liquid ink and solid ink are available.

As curable resin composition employed in the present invention, any composition can be used as long as it has ink acceptability, and it can be set by at least one of irradiation of light, or heating and light irradiation. For example, resins such as acrylic resins, epoxy resins, silicone resins, cellulose derivatives such as hydroxypropyl cellulose, hydroxyethyl cellulose, methylcellulose, carboxymethyl cellulose or degenerated materials thereof can be employed.

To advance cross-linking reaction by light, or light and heat, a photo-initiator (cross-linking agent) can be employed. As the cross-linking agent, bichromate, bisazide, radical initiator, cationic initiator, anionic initiator and the like can be employed. Further, these photo-initiators can be mixed or they can be combined with other sensitizers. Moreover, a photooxide generator, such as onium salt or the like, may be used in combination as the cross-linking agent. To further advance the cross-linking reaction, heating processing can be performed after irradiation of light.

The resin layer including the above compositions has excellent thermal resistance and water resistance so as to sufficiently endure high temperature post-process or cleaning process.

As the ink-jet method used in the present invention, a bubble-jet type method using electrothermal transducer as an energy generating element, or a piezo-jet type method using a piezoelectric element can be employed. The size of colored area and the coloring pattern can be arbitrarily set.

Moreover, although the present embodiment shows an example where the black matrix is formed on the substrate, the black matrix may be formed on the resin layer after the curable resin composition layer is formed or after coloring is performed, and the form thereof is not limited to that of the present embodiment. Further, for the forming method of the black matrix, it is preferable that a metal thin film is formed on a substrate by sputtering or deposition method and patterning is performed by photolithography process. However, the forming method is not limited to this.

Figure 5F:
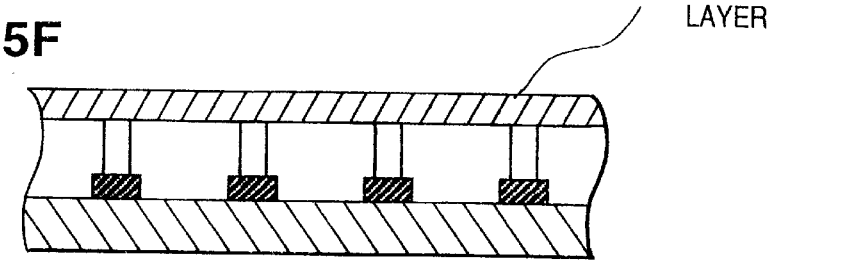

Next, the resin composition is set by irradiation of light only, or heating processing only, or irradiation of light and heating processing (FIG. 5E), and a protective layer 8 is formed in accordance with necessity (FIG. 5F). Note that in FIGS. 5A to 5F, sign hv denotes the intensity of light. In case of heating processing, the resin layer is set by heat instead of light of the intensity hv. The protective layer 8 is formed by using a second resin composition of photo-setting type, heat-setting type or photo- and heat-setting type, or by vapor deposition or sputtering using inorganic material. Any material can be used to form the protective layer 8 as long as it has transparency and sufficient durability at ITO formation process, orientation film formation process and the like performed thereafter.

Figure 6:
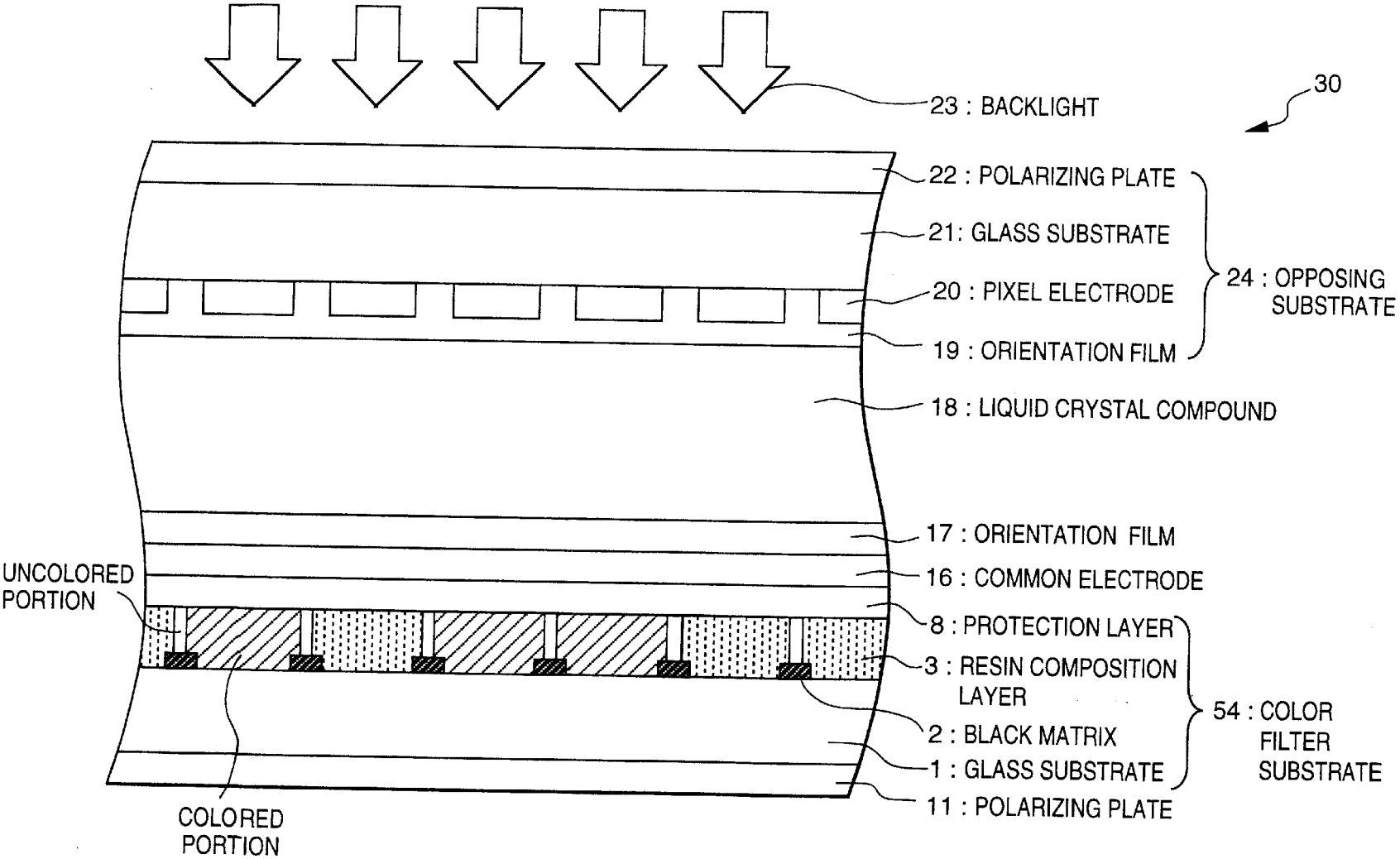
FIG. 6 is a cross-sectional view showing an example of a basic structure of a color liquid crystal display apparatus incorporating the color filter according to the present embodiment.
Figure 7:
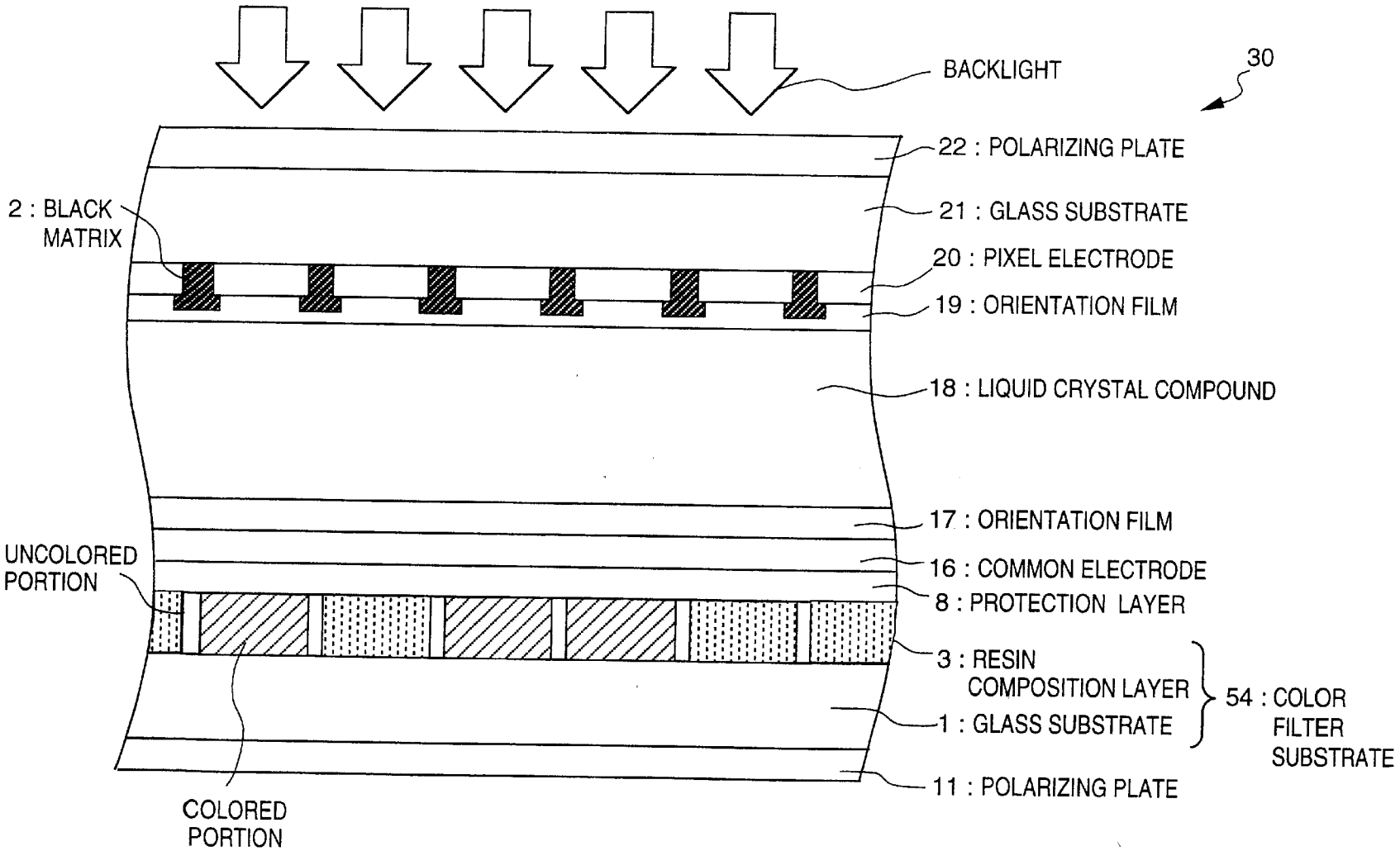
FIG. 7 is a cross-sectional view showing another example of a basic structure of a color liquid crystal display apparatus incorporating the color filter according to the present embodiment.
Figure 8:
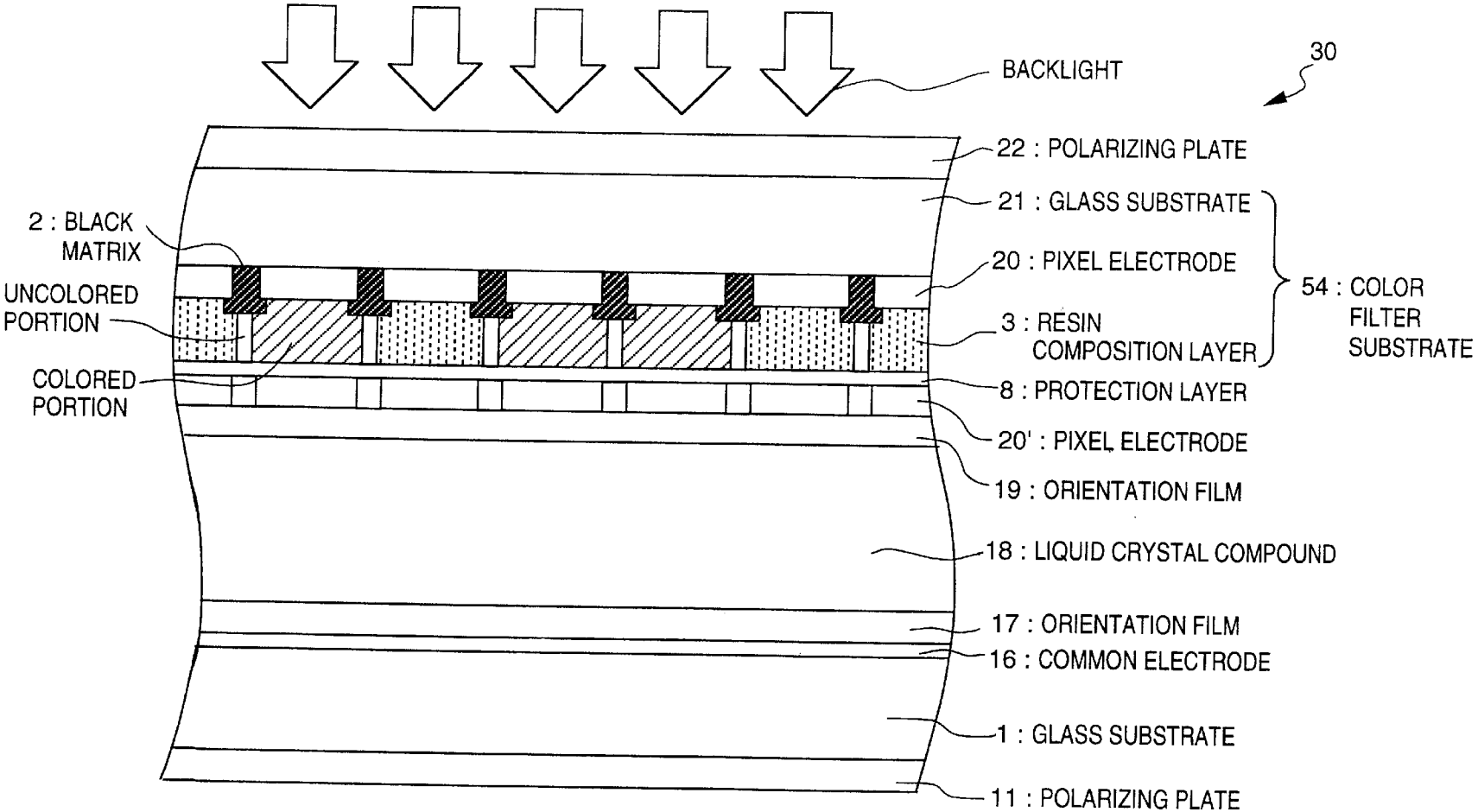
FIG. 8 is a cross-sectional view showing another example of a basic structure of a color liquid crystal display apparatus incorporating the color filter according to the present embodiment.

FIGS. 6 to 8 are cross sectional views showing the basic structure of a color liquid crystal display apparatus 30 incorporating the above-described color filter.

Generally, the color liquid-crystal display device is formed by assembling the color filter substrate 54 and an opposing substrate 24 and filling liquid crystal compound 18 between them. On the inner surface of the substrate 24, a TFT (Thin Film Transistor) (not shown) and transparent pixel electrodes 20 are formed in matrix. On the inner surface of the other color filter substrate 54, a coloring portion where R, G and B coloring materials are arrayed in the position opposing to the pixel electrodes, is provided, and on top of that, a transparent counter electrode (common electrode) 16 is formed on the entire surface. Generally, the black matrix 2 is formed on the side of the color filter substrate 1 (see FIG. 6). However, in a case of a BM (black matrix) on-array type liquid crystal panel, the black matrix 2 is formed on the side of the TFT substrate opposing to the color filter substrate (see FIG. 7). Further, an orientation film 19 is formed on the surfaces of the both substrates 1 and 21. Liquid-crystal molecules can be oriented in a uniform direction by rubbing processing on the orientation film 19. Further, polarizing plates 11 and 22 are attached to the outer surfaces of the respective glass substrates. The liquid crystal compound 18 is filled in the joint clearance (about 2 to 5 $\mu$m) between these glass substrates. As a backlight, the combination of a fluorescent light (not shown) and a light-scattering plate (not shown) is generally used. The liquid-crystal compound functions as an optical shutter to change transmissivity of the backlight, which realizes display.

Furthermore, as shown in FIG. 8, a coloring portion may be formed on the pixel electrodes 20 and may be made to serve as a color filter. In other words, the coloring portion constructing the color filter is not limited to being formed on the glass substrate. Note that the form shown in FIG. 8 includes a case where an ink-accepting layer is formed on the pixel electrodes and ink is discharged on the ink-receiving layer, and a case where resinous ink, into which coloring material is mixed, is directly discharged to the pixel electrodes.

A case where the above liquid crystal display device is applied to an information processing apparatus will be described below with reference to FIGS. 9 to 11.

Figure 9:
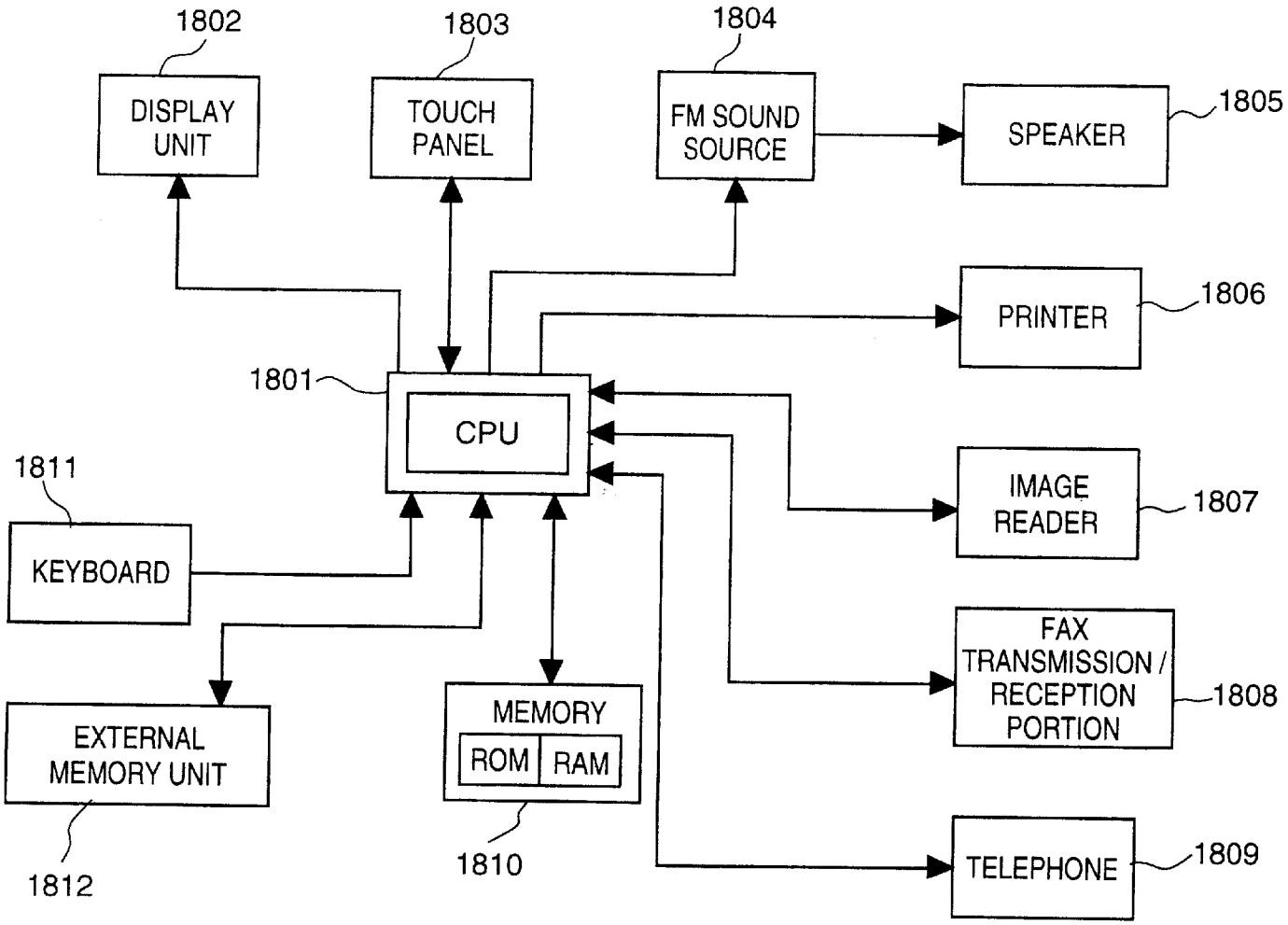
FIG. 9 is a block diagram showing an information processing apparatus to which the liquid crystal display device is applied.

FIG. 9 is a block diagram showing the schematic arrangement of an information processing apparatus serving as a word processor, a personal computer, a facsimile apparatus, and a copying machine, to which the above liquid crystal display device is applied.

Referring to FIG. 9, reference numeral 1801 denotes a control unit for controlling the overall apparatus. The control unit 1801 includes a CPU such as a microprocessor and various I/O ports, and performs control by outputting/inputting control signals, data signals, and the like to/from the respective units. Reference numeral 1802 denotes a display unit for displaying various menus, document information, and image data read by an image reader unit 1807, and the like on the display screen; 1803, a transparent, pressure-sensitive touch panel mounted on the display unit 1802. By pressing the surface of the touch panel 1803 with a finger or the like, an item input operation, a coordinate position input operation, or the like can be performed on the display unit 1802.

Reference numeral 1804 denotes an FM (Frequency Modulation) sound source unit for storing music information, created by a music editor or the like, in a memory unit 1810 or an external memory unit 1812 as digital data, and reading out the information from such a memory, thereby performing FM modulation of the information. Electric signals from the FM sound source unit 1804 are converted into audible sound by a speaker unit 1805. A printer unit 1806 is used as an output terminal for a word processor, a personal computer, a facsimile apparatus, and a copying machine.

Reference numeral 1807 denotes an image reader unit for photoelectrically reading original data. The image reader unit 1807 is arranged midway along the original convey passage and designed to read originals for facsimile and copy operations, or other various originals.

Reference numeral 1808 denotes a transmission/reception unit for the facsimile (FAX) apparatus. The transmission/reception unit 1808 transmits original data read by the image reader unit 1807 by facsimile, and receives and decodes facsimile signals. The transmission/reception unit 1808 has an interface function for external units. Reference numeral 1809 denotes a telephone unit having a general telephone function and various telephone functions such as an answering function.

Reference numeral 1810 denotes a memory unit including a ROM for storing system programs, manager programs, application programs, fonts, and dictionaries, a RAM for storing an application program loaded from the external memory unit 1812 and document information, a video RAM, and the like.

Reference numeral 1811 denotes a keyboard unit for inputting document information and various commands.

Reference numeral 1812 denotes an external memory unit using a floppy disk, a hard disk, and the like. The external memory unit 1812 serves to store document information, music and speech information, application programs for the user, and the like.

Figure 10:
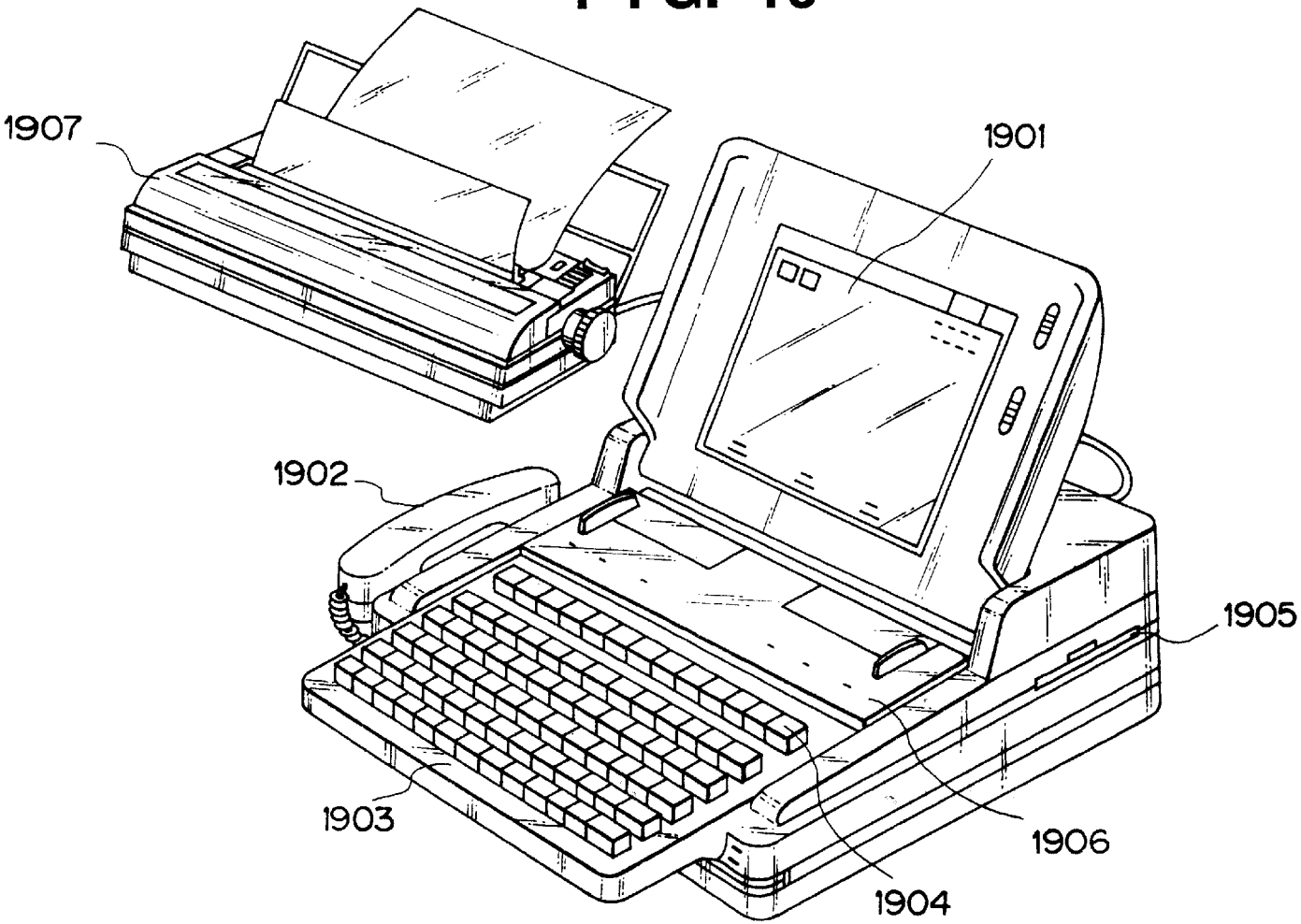
FIG. 10 is a perspective view showing an information processing apparatus to which the liquid crystal display device is applied.

FIG. 10 is a perspective view of the information processing apparatus in FIG. 9.

Referring to FIG. 10, reference numeral 1901 denotes a flat panel display using the above liquid crystal display device, which displays various menus, graphic pattern information, document information, and the like. A coordinate input or item designation input operation can be performed on the flat panel display 1901 by pressing the surface of the touch panel 1803 with a finger of the user or the like. Reference numeral 1902 denotes a handset used when the apparatus is used as a telephone set. A keyboard 1903 is detachably connected to the main body via a cord and is used to perform various document functions and input various data. This keyboard 1903 has various function keys 1904. Reference numeral 1905 denotes an insertion port through which a floppy disk is inserted into the external memory unit 1812.

Reference numeral 1906 denotes an original insertion table on which an original to be read by the image reader unit 1807 is placed. The read original is discharged from the rear portion of the apparatus. In a facsimile receiving operation or the like, received data is printed by an ink-jet printer 1907.

In a case where the above information processing apparatus serves as a personal computer or a word processor, various kinds of information input through the keyboard unit 1811 are processed by the control unit 1801 in accordance with a predetermined program, and the resultant information is output, as an image, to the printer unit 1806.

In a case where the information processing apparatus serves as a receiver of the facsimile apparatus, facsimile information input through the transmission/reception unit 1808 via a communication line is subjected to reception processing in the control unit 1801 in accordance with a predetermined program, and the resultant information is outputted, as a received image, to the printer unit 1806.

In a case where the information processing apparatus serves as a copying machine, an original is read by the image reader unit 1807, and the read original data is output, as an image to be copied, to the printer unit 1806 via the control unit 1801. Note that in a case where the information processing apparatus serves as a transmitter of the facsimile apparatus, original data read by the image reader unit 1807 is subjected to transmission processing in the control unit 1801 in accordance with a predetermined program, and the resultant data is transmitted to a communication line via the transmission/reception unit 1808.

Figure 11:
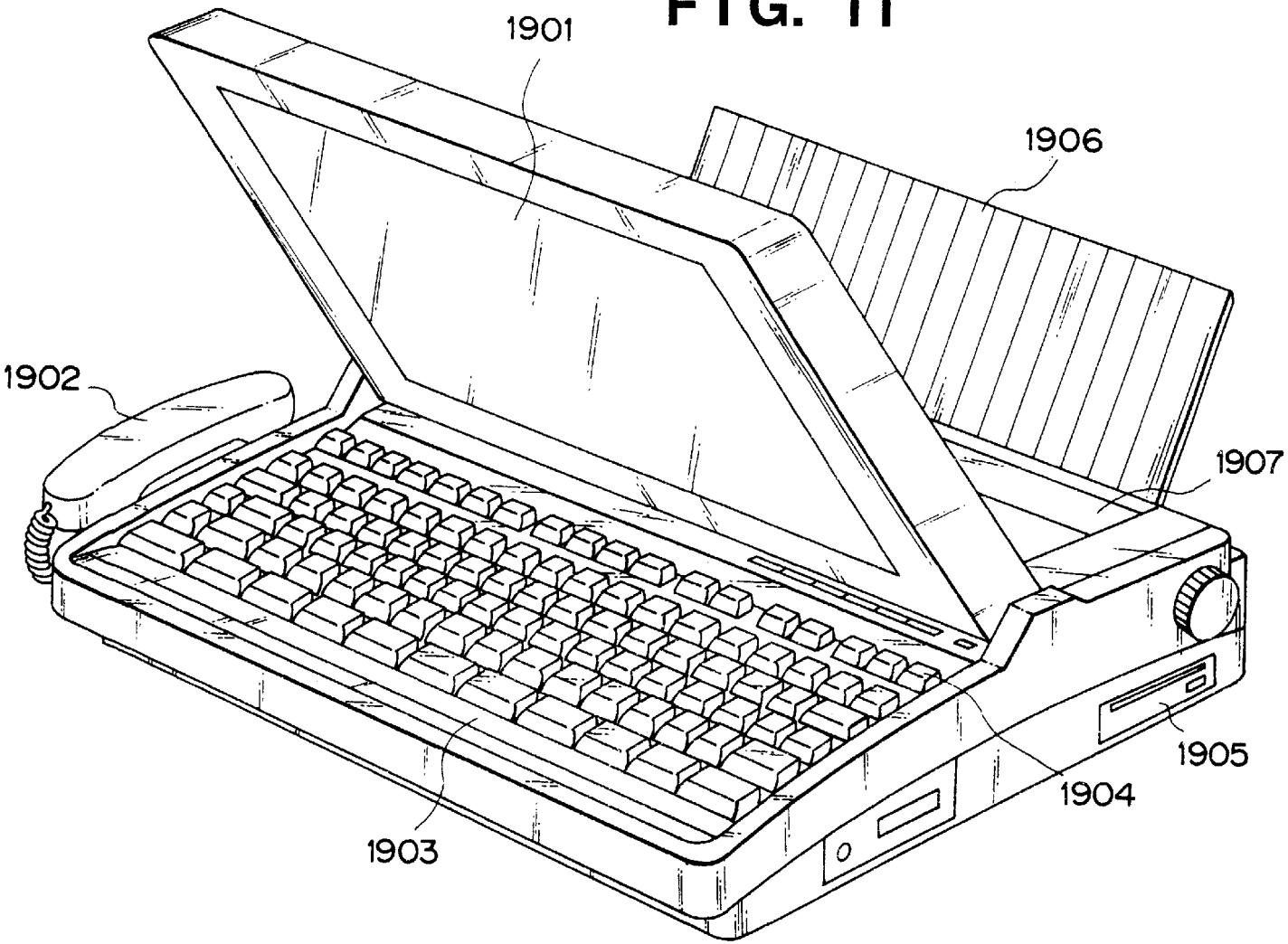
FIG. 11 is a perspective view showing an information processing apparatus to which the liquid crystal display device is applied.

Note that the above information processing apparatus may be designed as an integrated apparatus incorporating an ink-jet printer in the main body, as shown in FIG. 11. In this case, the portability of the apparatus can be improved. The reference numerals in FIG. 11 denote parts having the same functions as those in FIG. 10.

Figure 12:
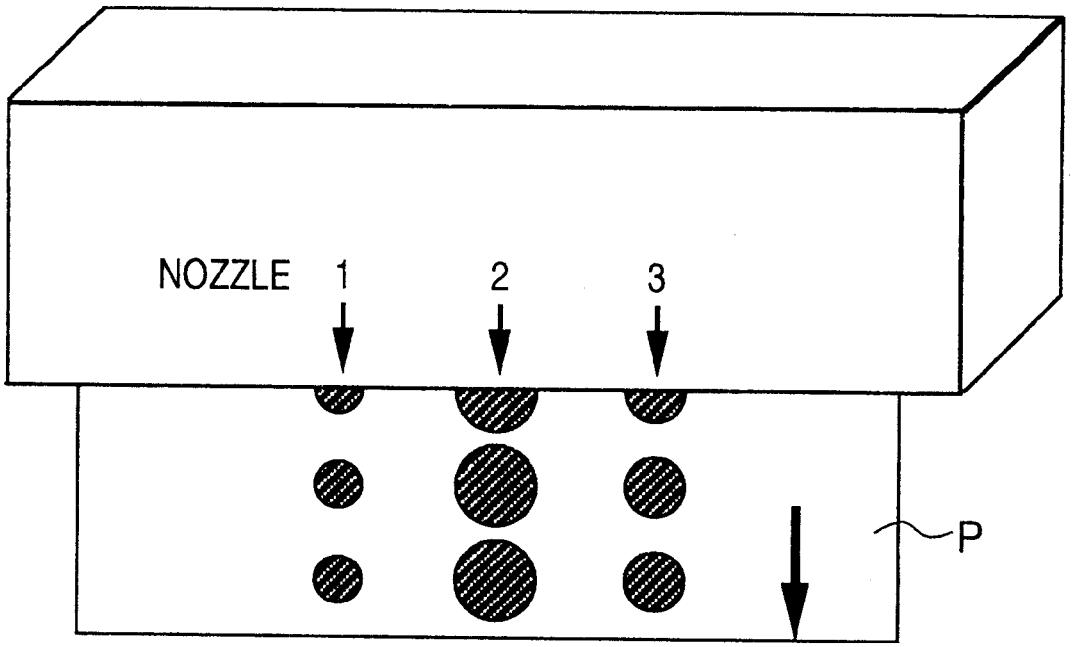
FIG. 12 is an explanatory view for explaining the method of correcting differences in ink-discharge amount among nozzles.
Figure 13:
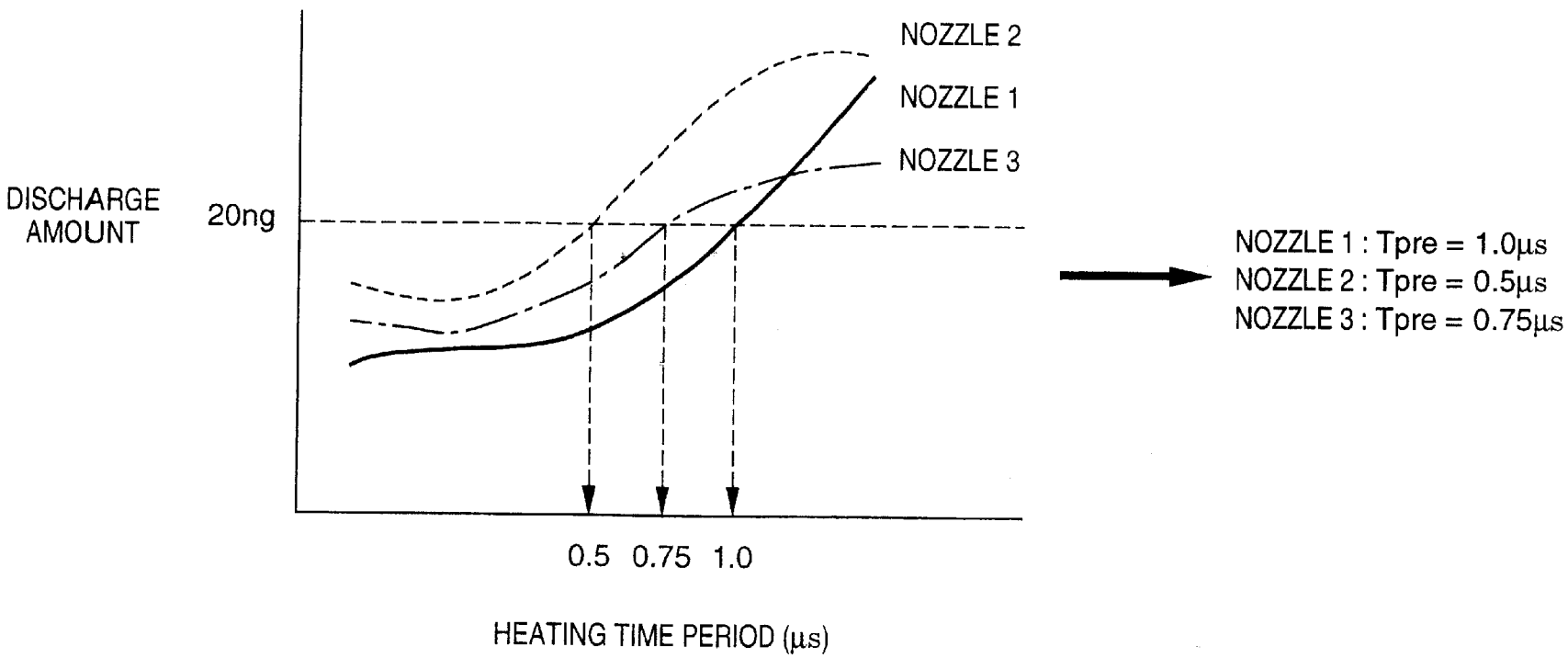
FIG. 13 is a graph for explaining the method of correcting differences in ink-discharge among nozzles.
Figure 14:
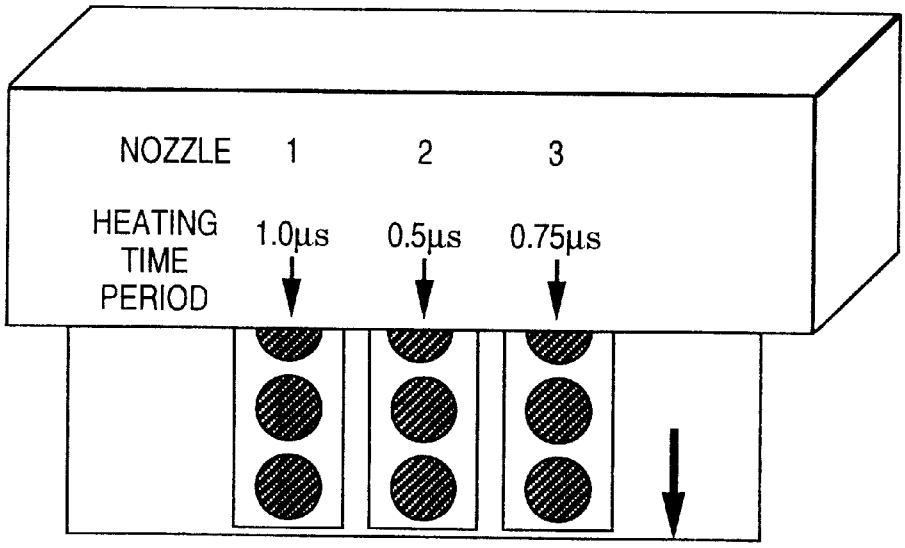
FIG. 14 is an explanatory view for explaining the method of correcting differences in ink-discharge amount among nozzles.

Next, description will be provided on two typical methods of reducing density unevenness of pixels of the color filter. FIGS. 12 to 14 are explanatory views for explaining the method of correcting (hereinafter referred to as bit correction) differences in ink-discharge amount among nozzles of an ink-jet head IJH having a plurality of ink discharge nozzles.

First, as shown in FIG. 12, ink is discharged onto a predetermined substrate by three nozzles, e.g., nozzles 1, 2 and 3 of the ink-jet head IJH, and the sizes of ink dots formed with the ink discharged by each of the nozzles on the substrate P is measured, whereby measuring the ink-discharge amount of each nozzle. A heat pulse (see FIG. 4) to be applied to the heater of each nozzle is first set to a fixed pulsewidth, and the pulsewidth of the preheat pulse is altered as has been described above (see FIG. 4). As a result, curves as shown in FIG. 13, showing relationship between a preheat pulsewidth (shown as heating time period in FIG. 13) and the ink-discharge amount, can be obtained. Assuming herein that all the ink-discharge amount of nozzles is to be controlled to 20 ng, it is found from the curves shown in FIG. 13 that the pulsewidth of the preheat pulse to be applied to the nozzle 1 is 1.0 $\mu$s; to the nozzle 2, 0.5 $\mu$s; and to the nozzle 3, 0.75 $\mu$s. Therefore, by applying a preheat pulse having the aforementioned width to the heater of each nozzle, it is possible to control all the ink-discharge amount of each nozzle to the fixed amount of 20 ng as shown in FIG. 14. Correction of an ink-discharge amount of each nozzle in the foregoing manner is called bit correction.

Figure 15:
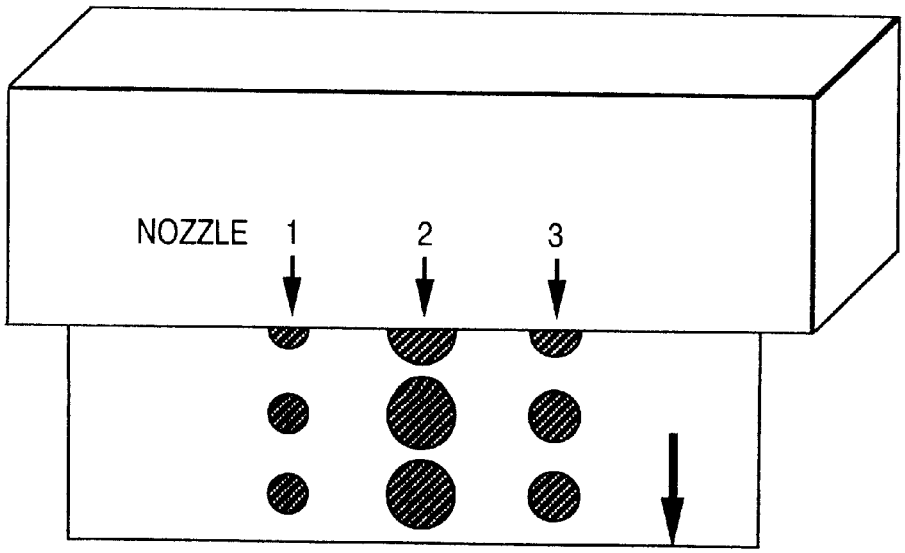
FIG. 15 is an explanatory view for explaining the method of changing ink discharge density.
Figure 16:
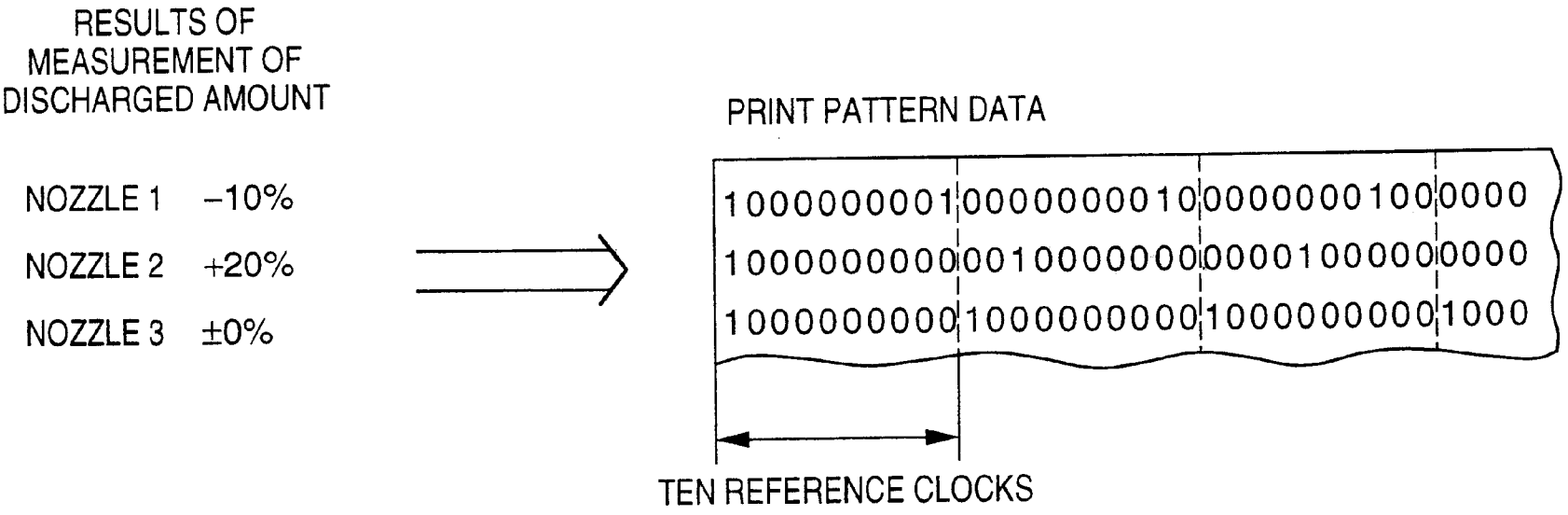
FIG. 16 is an explanatory view for explaining the method of changing ink discharge density.
Figure 17:
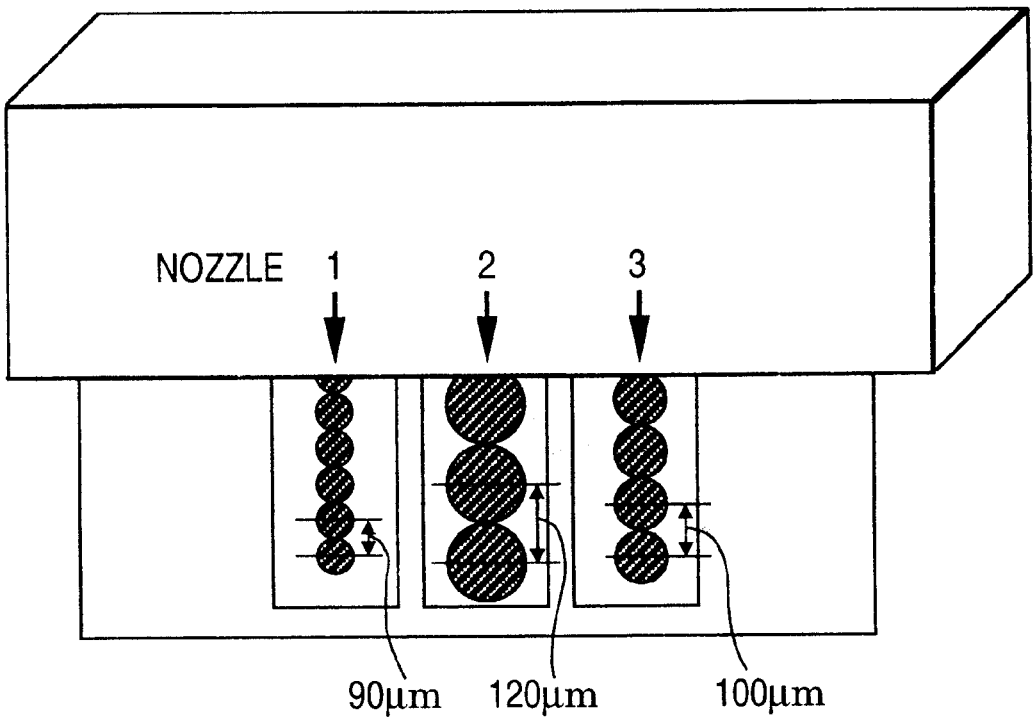
FIG. 17 is an explanatory view for explaining the method of changing ink discharge density.

FIGS. 15 to 17 are explanatory views for explaining the method of correcting (hereinafter referred to as shading correction) density unevenness in the scanning direction of the ink-jet head by adjusting density of ink discharged by each of the ink-discharging nozzles.

For instance, as shown in FIG. 15, when the amount of ink discharged by the nozzle 3 of the ink-jet head is defined as reference, assume that the amount of ink discharged by nozzle 1 is 10% less than the reference, and the amount of ink discharged by nozzle 2 is 20% more than the reference. Under this condition, while scanning the ink-jet head IJH, a heat pulse is applied to the heater of the nozzle 1 once every nine reference clocks, a heat pulse is applied to the heater of the nozzle 2 once every twelve reference clocks, and a heat pulse is applied to the heater of the nozzle 3 once every ten reference clocks, as shown in FIG. 16. In the above manner, the number of ink-discharge operation in the scanning direction can be adjusted for each nozzle, thereby making it possible to realize constant ink density in the pixels of a color filter in the scanning direction as shown in FIG. 17. Accordingly, it is possible to prevent density unevenness among pixels. Correction of ink-discharge density in the scanning direction in the foregoing manner is called shading correction.

As an application of the above-described correction methods, Japanese Patent Application No. 8-341351 proposes a method of reducing density unevenness among pixel columns by combining the aforementioned shading correction and bit correction. According to the proposed method, density unevenness is greatly reduced, thus a high-quality color filter can be manufactured. However, since the method employs the combination of shading correction and bit correction, there is a drawback of complicated control operation.

Figure 18:
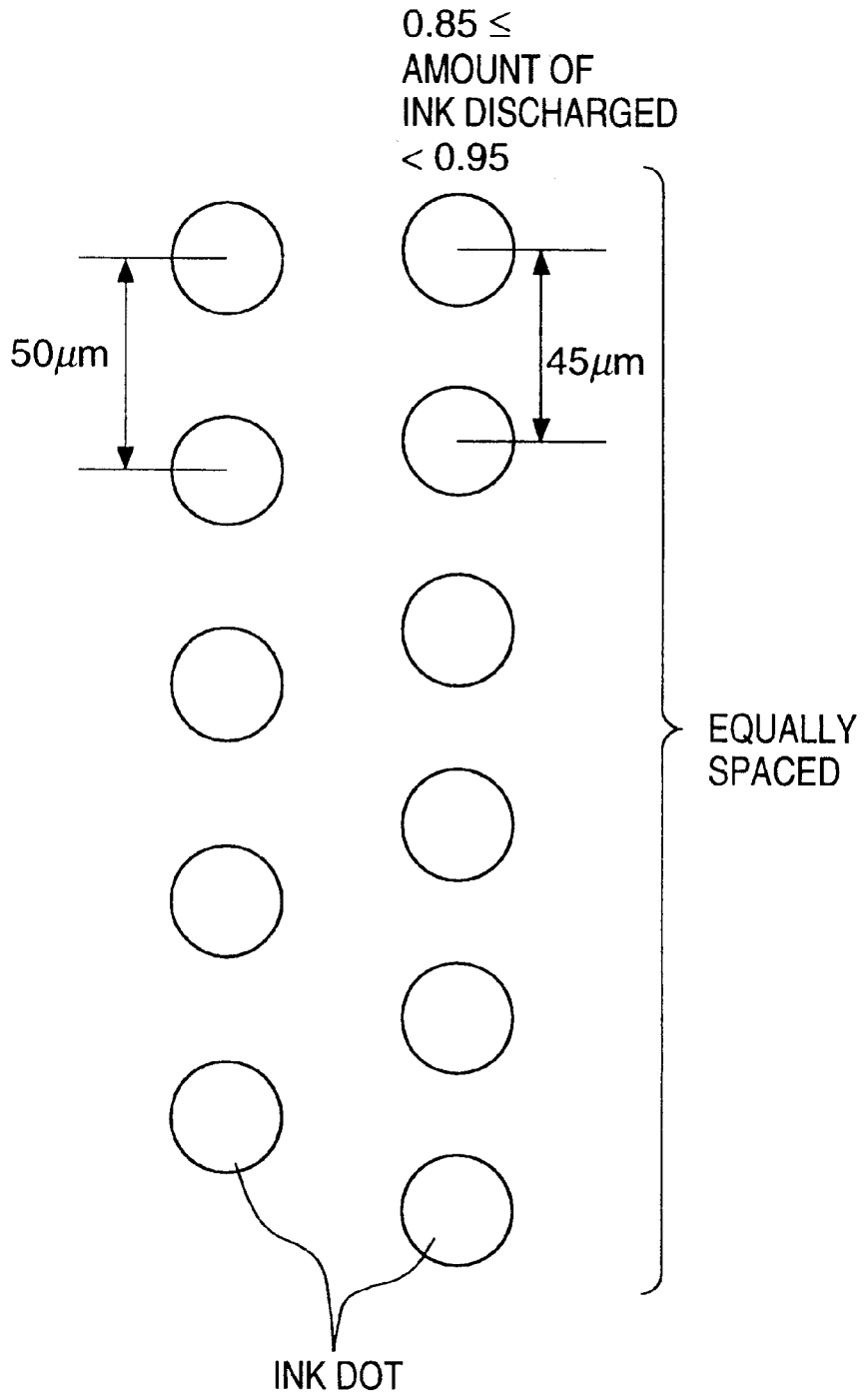
FIG. 18 is an explanatory view showing ink dots being discharged at a constant pitch.

For instance as shown in FIG. 18, in the normal shading correction technique, assume that an amount of ink discharged per single discharge operation (one ink dot) of a reference nozzle is 1, and an appropriate ink-discharge pitch of the reference nozzle is 50 $\mu$m. If an amount of ink discharged by one of the nozzles is 0.85, an appropriate ink-discharge pitch for this nozzle is $50\times(0.85/1)=42.5$ $\mu$m. In other words, in a case where coloring is performed by a nozzle capable of discharging a small amount of ink per single discharge operation, the small amount of ink discharge is compensated by reducing the ink-discharge pitch to increase the number of ink dots discharged onto one pixel (cell), and as a result, the total amount of ink discharged to the pixels (cells) is kept constant.

At this stage, if a moving pitch (pitch in which discharge is possible) of the ink-jet head with relative to the color filter substrate is made too small, the amount of data to be processed increases, resulting in extremely time consuming control operation. In other words, the minimum moving pitch has a limitation. In practice, considering the time required to manufacture a color filter, about 10% of the average ink-discharge pitch is the realistic value for a minimum moving pitch of the ink-jet head with relative to the color filter substrate. In a case where the minimum moving pitch is 10% of the ink-discharge pitch, the ink-discharge position is deviated by ±5% from the ideal ink-dot position (in the present embodiment, a position spaced away from the starting point by 50 $\mu$m). More specifically, because of the aforementioned limitation, even if a nozzle having a discharge amount of 0.85 attempts to discharge ink at a position spaced away from the starting point by 42.5 $\mu$m, the position where ink is actually discharged is either a position spaced away from the starting point by 40 $\mu$m or 45 $\mu$m. As a result, the actually discharged position deviates from the ideal ink-dot position by 2.5 $\mu$m at maximum.

In the foregoing technique disclosed in Japanese Patent Application No. 8-341351, in a case where an ideal ink-discharge position is, for instance, a position spaced away from the starting point by 42.5 $\mu$m, in view of the aforementioned limitation, all the ink-discharge pitch is controlled to 45 $\mu$m as shown in FIG. 18, and ink is discharged at a constant pitch of 45 $\mu$m. Thus, if pixel columns having a predetermined length are colored, the total amount of ink discharged in one cell is smaller in a case of discharging ink at 45 $\mu$m pitch, than the case of ideally discharging ink at 42.5 $\mu$m pitch. As a result, the following equation holds: actual amount of ink discharged=ideal amount of ink discharge$\times$(42.5/45). Thus, the total amount of ink actually discharged is smaller by about 5% than the ideal total amount of ink discharge. Meanwhile, in a case of a nozzle whose amount of ink discharge is 0.95, the ideal discharge pitch is 47.5 $\mu$m. Similar to the above, in a case where ink is discharged by the nozzle at a constant pitch of 45 $\mu$m, the actual total amount of ink discharged (in one cell) is larger by about 5% than the ideal total amount of ink discharge. As described above, when the minimum moving pitch of the ink-jet head with relative to the color filter substrate is 10% of the ink-discharge pitch, the total amount of ink discharged to the pixel columns fluctuates by ±5%.

In order to solve the above problem, in the technique disclosed in Japanese Patent Application No. 8-341351, the total amount of ink fluctuated by the above shading correction is further corrected by correcting the amount of ink discharged per single discharge, utilizing the technique of aforementioned bit correction, so as to achieve a value close to the ideal total amount of ink discharged to the pixel columns. Such combination of shading correction and bit correction results in complication of control operation.

The present invention is proposed to further improve the above-described method.

Figure 19:
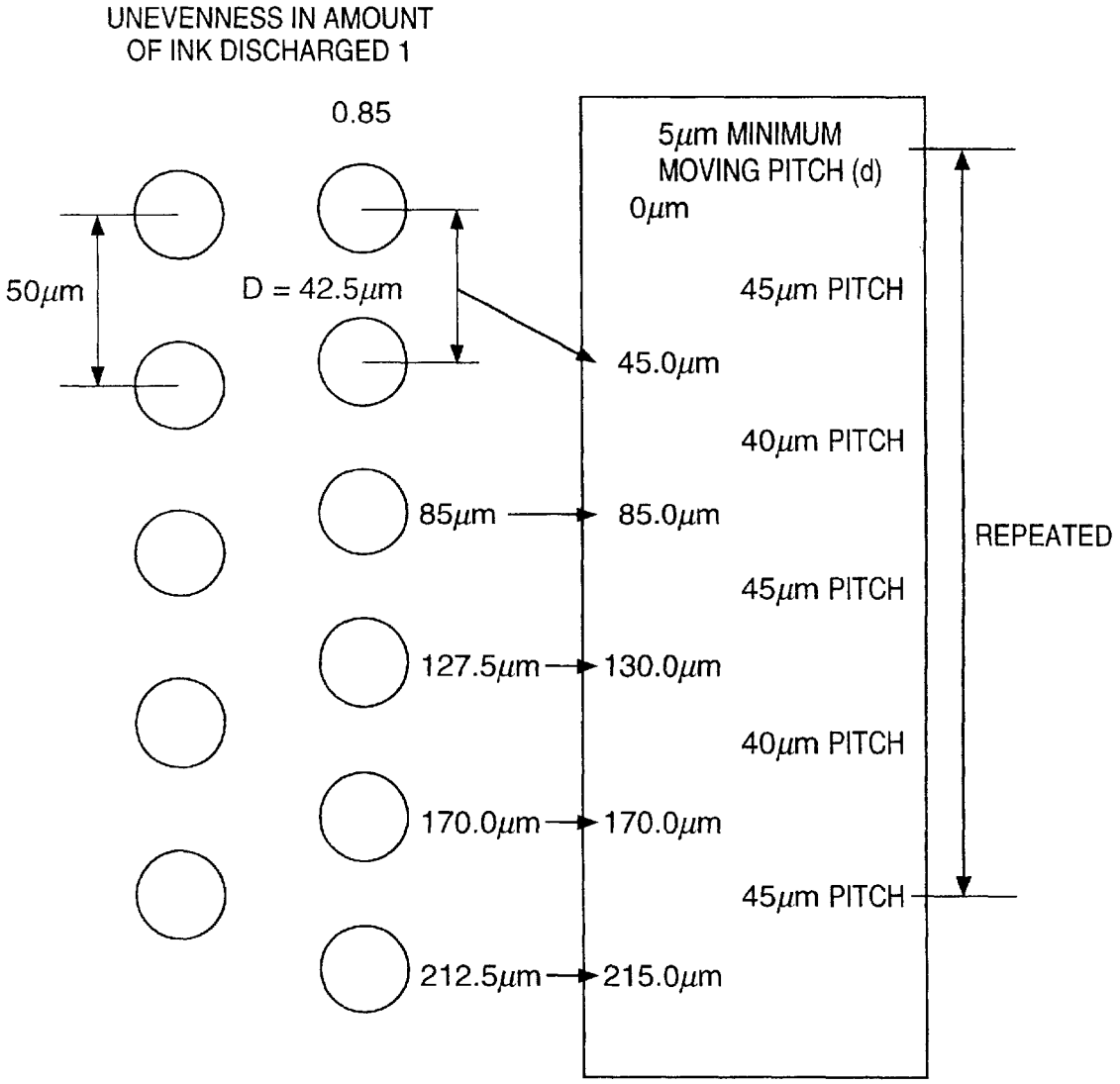
FIG. 19 is an explanatory view for explaining the method of shading correction according to the present embodiment.

Hereinafter, description will be provided with reference to FIG. 19, on the technique of shading correction as a characteristic portion of the present embodiment.

As has been described with reference to FIG. 18, assume that an amount of ink discharged by a reference nozzle is 1, and an amount of ink discharged by one of the nozzles is 0.85. In this case, if an ideal ink-discharge pitch of the reference nozzle, having an ink-discharge amount 1, is 50 μm, the ink-discharge pitch D, which is ideal to equalize the total amount of ink discharged in one cell, for the nozzle having an ink-discharge amount of 0.85, is 42.5 μm as has been mentioned above. It is assumed herein that the minimum moving pitch d of the ink-jet head with relative to the color filter substrate is 5 μm.

In the present embodiment, the nozzle, having an ink-discharge amount of 0.85, first discharges ink at the starting point of scanning of the ink-jet head (i.e., k=0). Although the position for discharging ink for the second time (i.e., k=1) is spaced away from the starting point by 42.5 μm, the nozzle is unable to discharge ink at this position due to the limitation of the minimum moving pitch of the ink-jet head relative to the color filter substrate. Thus, ink is discharged at a position spaced away from the starting position by 45 μm pitch, which is an integer multiple of the minimum moving pitch (5 μm) closest to 42.5 μm. In other words, since 42.5 μm is 8.5 multiples of the minimum moving pitch (5 μm), the tenth place of the value 8.5 is rounded to the nearest whole number 9 (i.e., n+1=9) in accordance with mathematical conventions. As a result, ink is discharged at a position corresponding to 9 multiples of the minimum moving pitch (5 μm), i.e., a position spaced away from the starting position by 45 μm.

Next, the position for discharging ink for the third time is spaced away from the starting point by 85 μm, i.e., 2 multiples of 42.5 μm. Since this value is an integer multiple of the minimum moving pitch (5 μm), the nozzle is able to discharge ink at this position.

Further, the position for discharging ink for the fourth time is spaced away from the starting point by 127.5 μm, 3 multiples of 42.5 μm. Similar to the second ink-discharge position, the nozzle is unable to discharge ink at this position. Therefore, ink is discharged at a position corresponding to a closest integer multiple of the minimum moving pitch , i.e. a position spaced away from the starting position by 130 μm.

In the subsequent discharge operation, when the integer multiple of 42.5 μm coincides the integer multiple of the minimum moving pitch (5 μm), ink is discharged at that position. When the integer multiple of 42.5 μm does not coincide the integer multiple of the minimum moving pitch, ink is discharged at a position corresponding to a closest integer multiple of the minimum moving pitch.

As a result, there is only a single dot difference at maximum, between the total number of ink dots actually discharged onto the pixel columns and the ideal total number of ink dots. Therefore, the total number of ink dots actually discharged to the pixel columns almost perfectly achieves the ideal total number of ink dots.

For instance, when one of the lines of a stripe-type color filter is to be colored, assuming that the length of one line is 150 mm and ink-discharge pitch is 50 μm, the total of 3,000 dots are discharged to the line. In this case, the total number of ink dots actually discharged to the line has an error of only one dot, compared to the ideal total number of ink dots. Thus, the error in the total amount of ink discharged in a plurality of lines is $\pm 1/3{,}000 = \pm 0.034\%$ or less.

As set forth above, according to the present embodiment, it is possible to control the total amount of ink discharged to each of the pixel columns with high precision, by shading correction only.

Note that the reference amount of ink discharged (1 in the above example), is an average value of amounts of ink discharged by all nozzles of the ink-jet head. Although the above description is provided on the nozzle having an ink-discharge amount 0.85, the same correction operation is performed for a nozzle having a different ink-discharge amount.

Moreover, the same effect can be attained not only in a stripe-type color filter where coloring is performed in unit of pixel columns, but also in a delta-type color filter where coloring is performed in unit of pixels, by reducing the amount of ink discharged per single discharge operation, or by lowering ink density and increasing the number of ink dots discharged.

Note that the above-described details is expressed in the following equation. Discharge pitch Pn of an n-th nozzle for performing shading correction is expressed as follows:

$$Pn=(Vn/Vave)\cdot Ps$$

where the number of nozzles of ink-jet head: N an amount of ink discharged by the n-th nozzle: Vn (ng)

an average discharge amount of all nozzles: $Vave=(\Sigma Vn/N)$ (ng)

reference discharge pitch to be discharged by a nozzle satisfying Vn=Vave: Ps (μm/dot)

minimum moving pitch: Pr (μm)

A discharge pitch of each nozzle is expressed by Pn and a multiple of Pn is set to a value closest to a multiple of the minimum moving pitch. Therefore, an error is (1/total number of ink dots discharged).

In a stripe-type color filter, an error generated in each pixel can be considered as an error for each line. Thus, an error in the ink-discharge amount generated among pixels is ± few tenths % or less.

As a matter of course, the same effect is attained in a case of a delta-type color filter, by using an ink-jet head having a small discharge amount and applying the same technique as above.

Figure 20:
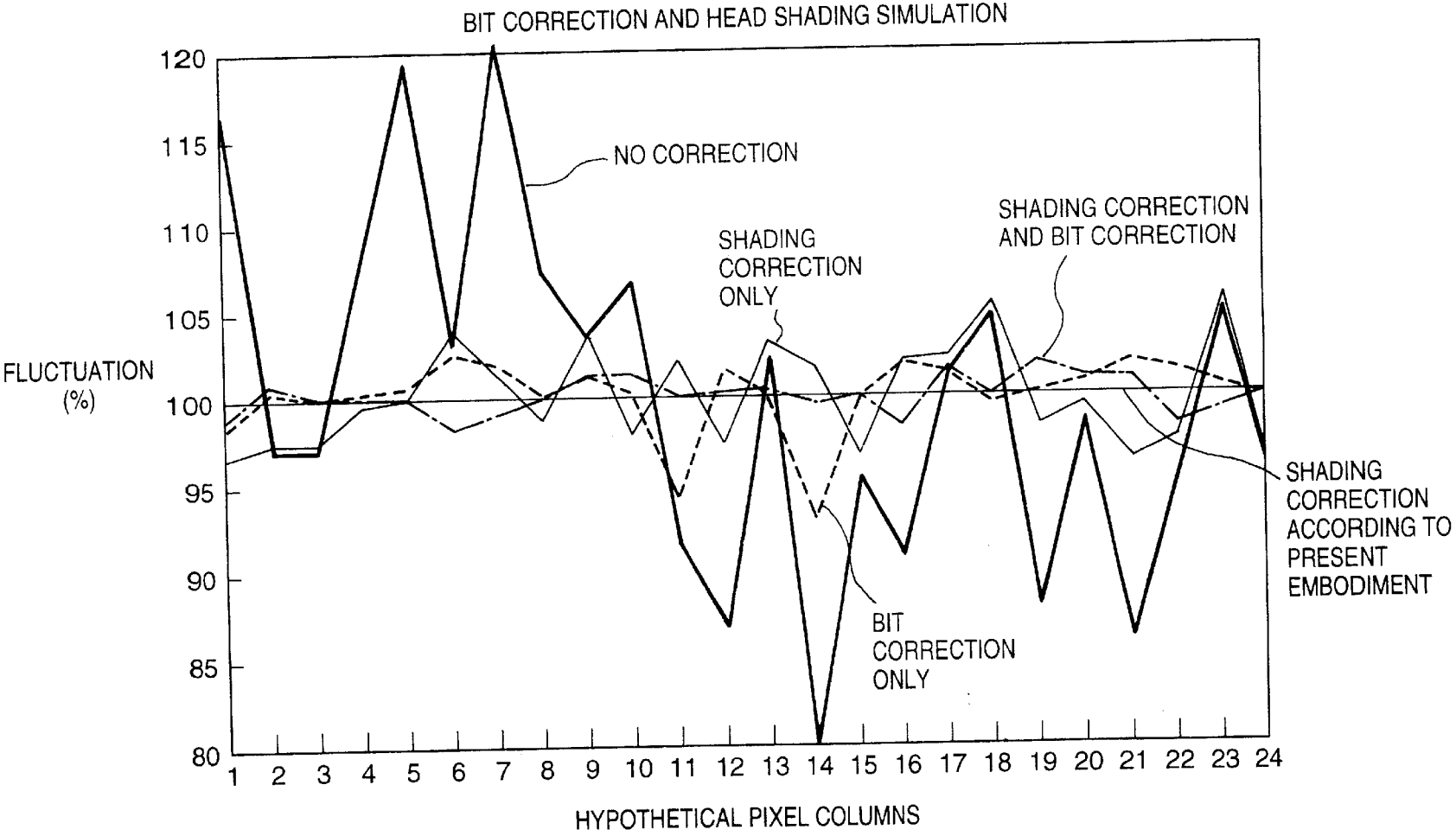
FIG. 20 is a graph showing levels of fluctuation of the amount of ink obtained by the method according to the present invention or by other methods.

FIG. 20 is a graph showing simulation results of fluctuation in the amount of ink obtained in a case of manufacturing a stripe-type, 10.4-inch SVGA (Super Video Graphics Array) color filter with no correction, or performing only bit correction, or performing only shading correction, or performing both bit correction and shading correction. As can be seen from the graph, the method according to the present embodiment attains the highest precision in manufacturing a color filter.

As set forth above, according to the present embodiment, it is possible to greatly reduce color density unevenness in pixels of a color filter, whereby making it possible to manufacture a high-quality color filter.

Note that the present invention is applicable to a corrected and modified case of the above-described embodiment without departing from the spirit of the present invention. Also, further improved effect can be expected by combining the present invention with bit correction.

The embodiment described above has exemplified a printer, which comprises means (e.g., an electrothermal transducer, laser beam generator, and the like) for generating heat energy as energy utilized upon execution of ink discharge, and causes a change in state of ink by the heat energy, among the ink-jet printing methods. According to this ink-jet printing method and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse-form driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive ink from the apparatus main unit upon being mounted on the apparatus main unit, or a cartridge type printhead in which an ink tank is integrally arranged on the printhead itself, is applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Moreover, in the above-mentioned embodiment of the present invention, it is assumed that the ink is liquid. Alternatively, the present invention may employ ink which is solid at room temperature or less, or ink which softens or liquefies at room temperature, or ink which liquefies upon application of a printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, ink which is solid in a non-use state and liquefies upon heating may be used. In any case, ink which liquefies upon application of heat energy according to a printing signal and is discharged in a liquid state, ink which begins to solidify when it reaches a printing medium, or the like, is applicable to the present invention. In the present invention, the above-mentioned film boiling system is most effective for the above-mentioned ink.

As has been set forth above, according to the present embodiment, it is possible to greatly reduce color density unevenness among pixels of a color filter, whereby making it possible to manufacture a high-quality color filter.

Moreover, since the amount of ink is adjusted by shading correction only, control operation is simplified.

The present invention is not limited to the above embodiments and various changes and modifications can be made within the spirit and scope of the present invention. Therefore, to appraise the public of the scope of the present invention, the following claims are made.

What is claimed is:

1. A color-filter manufacturing method of coloring pixels of a color-subject material by scanning an ink-jet head, having a plurality of ink-discharge nozzles in a direction substantially orthogonal to a scanning direction, relative to the color-subject material, and discharging ink to the color-subject material by the plurality of ink-discharge nozzles, comprising the steps of:

calculating a theoretical ink discharge pitch D for ink-discharge nozzles of the ink-jet head in accordance with an amount of ink discharged per single discharge of each of those ink-discharge nozzles for which the calculation is performed, in order to make an amount of ink discharged for each pixel constant; and discharging ink such that, assuming a minimum moving pitch of an amount of relative movement of the ink-jet head in the scanning direction is d, in a case where a value kD (k is an integer multiple of the theoretical pitch equal to or larger than 0) corresponding to a theoretical discharge position of an n-th ink dot discharged along the scanning direction coincides with nd (n is an integer multiple, equal to or larger than 0, of the minimum moving pitch corresponding to a theoretical discharge position of the n-th ink dot), ink is discharged at a position satisfying kd=nd, and in a case where Kd takes a value between nd and (n+1)d, ink is discharged at a position corresponding to nd or a position corresponding to (n+1)d.

2. The color-filter manufacturing method according to claim 1, wherein in said ink discharging step, in a case where the value of kD=(n+a)d (0<a<1), the tenth place of the value a is rounded to the nearest whole number which is set as a value b (b=0 or 1), and ink is discharged at a position corresponding to (n+b)d.

3. The color-filter manufacturing method according to claim 1, wherein said ink-jet head is a printhead for discharging ink by utilizing heat energy, and includes heat energy transducers for generating heat energy to be applied to the ink.

4. A color filter manufactured by coloring pixels of a color-subject material by scanning an ink-jet head, having a plurality of ink-discharge nozzles in a direction substantially orthogonal to a scanning direction, relative to the color-subject material, and discharging ink to the color-subject material by the plurality of ink-discharge nozzles, said color filter manufactured by the steps of:

calculating a theoretical ink discharge pitch D for ink-discharge nozzles of the ink-jet head in accordance with an amount of ink discharged per single discharge of each of those ink-discharge nozzles for which the calculation is performed, in order to make an amount of ink discharged for each pixel constant; and discharging ink such that, assuming a minimum moving pitch of an amount of relative movement of the ink-jet head in the scanning direction is d, in a case where a value kD (k is an integer multiple of the theoretical pitch equal to or larger than 0) corresponding to a theoretical discharge position of an n-th ink dot discharged along the scanning direction coincides with nd (n is an integer multiple, equal to or larger than 0, of the minimum moving pitch corresponding to a theoretical discharge position of the n-th ink dot), ink is discharged at a position satisfying kD=nd, and in a case where kD takes a value between nd and (n+1)d, ink is discharged at a position corresponding to nd or a position corresponding to (n+1)d.

5. A display device including a color filter manufactured by coloring pixels of a color-subject material by scanning an ink-jet head, having a plurality of ink-discharge nozzles in a direction substantially orthogonal to a scanning direction, relative to the color-subject material, and discharging ink to the color-subject material by the plurality of ink-discharge nozzles, said display device integrally comprising:

light-amount changing means for changing an amount of light displayed; and a color filter for filtering the light displayed, manufactured by the steps of:

calculating a theoretical ink discharge pitch D for ink-discharge nozzles of the ink-jet head in accordance with an amount of ink discharged per single discharge of each of those ink-discharge nozzles for which the calculation is performed, in order to make an amount of ink discharged for each pixel constant; and discharging ink such that, assuming a minimum moving pitch of an amount of relative movement of the ink-jet head in the scanning direction is d, in a case where a value kD (k is an integer multiple of the theoretical pitch equal to or larger than 0) corresponding to a theoretical discharge position of an n-th ink dot discharged along the scanning direction coincides with nd (n is an integer multiple, equal to or larger than 0, of the minimum moving pitch corresponding to a theoretical discharge position of the n-th ink dot), ink is discharged at a position satisfying kd=nd, and in a case where kD takes a value between nd and (n+1)d, ink is discharged at a position corresponding to nd or a position corresponding to (n+1)d.

6. An apparatus having a display device which includes a color filter manufactured by coloring pixels of a color-subject material by scanning an ink-jet head, having a plurality of ink-discharge nozzles in a direction substantially orthogonal to a scanning direction, relative to the color-subject material, and discharging ink to the color-subject material by the plurality of ink-discharge nozzles, said apparatus comprising image-signal supplying means for supplying an image signal to the display device, said display device integrally comprising:

light-amount changing means for changing an amount of light displayed; and a color filter for filtering the light displayed, manufactured by the steps of:

calculating a theoretical ink discharge pitch D for ink-discharge nozzles of the ink-jet head in accordance with an amount of ink discharged per single discharge of each of those ink-discharge nozzles for which the calculation is performed, in order to make an amount of ink discharged for each pixel constant; and discharging ink such that, assuming a minimum moving pitch of an amount of relative movement of the ink-jet head in the scanning direction is d, in a case where a value kD (k is an integer multiple of the theoretical pitch equal to or larger than 0) corresponding to a theoretical discharge position of an n-th ink dot discharged along the scanning direction coincides with nd (n is an integer multiple equal to or larger than 0, of the minimum moving pitch corresponding to a theoretical discharge position of the n-th ink dot), ink is discharged at a position satisfying kD=nd, and in a case where kD takes a value between nd and (n+1)d, ink is discharged at a position corresponding to nd or a position corresponding to (n+1).

7. A color-filter manufacturing method of coloring pixels of a color-subject material by scanning an ink-jet head, having a plurality of ink-discharge nozzles in a direction substantially orthogonal to a scanning direction, relative to the color-subject material, and discharging ink to the color-subject material by the plurality of ink-discharge nozzles, comprising the steps of:

calculating a theoretical ink discharge pitch for ink-discharge nozzles of the ink-jet head in accordance with an amount of ink discharged per single discharge of each of those ink-discharge nozzles for which the calculation is performed, in order to make an amount of ink discharged for each pixel constant; and discharging ink such that, in a case where an integer multiple of the theoretical ink discharge pitch coincides with an integer multiple of a minimum moving pitch of an amount of relative movement of the ink-jet head in the scanning direction, ink is discharged at a position corresponding to the integer multiple of the minimum moving pitch, and in a case where an integer multiple of the theoretical ink discharge pitch does not coincide with an integer multiple of the minimum moving pitch of the amount of relative movement of the ink-jet head in the scanning direction, ink is discharged at a position corresponding to a closest integer multiple of the minimum moving pitch.

8. A color filter manufactured by coloring pixels of a color-subject material by scanning an ink-jet head, having a plurality of ink-discharge nozzles in a direction substantially orthogonal to a scanning direction, relative to the color-subject material, and discharging ink to the color-subject material by the plurality of ink-discharge nozzles, said color filter manufactured by the steps of:

calculating a theoretical ink discharge pitch for ink-discharge nozzles of the ink-jet head in accordance with an amount of ink discharged per single discharge of each those ink-discharge nozzles for which the calculation is performed, in order to make an amount of ink discharged for each pixel constant; and discharging ink such that, in a case where an integer multiple of the theoretical ink discharge pitch coincides with an integer multiple of a minimum moving pitch of an amount of relative movement of the ink-jet head in the scanning direction, ink is discharged at a position corresponding to the integer multiple of the minimum moving pitch, and in a case where an integer multiple of the theoretical ink discharge pitch does not coincide with an integer multiple of the minimum moving pitch of the amount of relative movement of the ink-jet head in the scanning direction, ink is discharged at a position corresponding to a closest integer multiple of the minimum moving pitch.

9. A display device including a color filter manufactured by coloring pixels of a color-subject material by scanning an ink-jet head, having a plurality of ink-discharge nozzles in a direction substantially orthogonal to a scanning direction, relative to the color-subject material, and discharging ink to the color-subject material by the plurality of ink-discharge nozzles, said display device integrally comprising:

light-amount changing means for changing an amount of light displayed; and a color filter for filtering the light displayed, manufactured by the steps of:

calculating a theoretical ink discharge pitch for ink-discharge nozzles of the ink-jet head in accordance with an amount of ink discharged per single discharge of each of those ink-discharge nozzles for which the calculation is performed, in order to make an amount of ink discharged for each pixel constant; and discharging ink such that, in a case where an integer multiple of the theoretical ink discharge pitch coincides with an integer multiple of a minimum moving pitch of an amount of relative movement of the ink-jet head in the scanning direction, ink is discharged at a position corresponding to the integer multiple of the minimum moving pitch, and in a case where an integer multiple of the theoretical ink discharge pitch does not coincide with an integer multiple of the minimum moving pitch of the amount of relative movement of the ink-jet head in the scanning direction, ink is discharged at a position corresponding to a closest integer multiple of the minimum moving pitch.

10. An apparatus having a display device which includes a color filter manufactured by coloring pixels of a color-subject material by scanning an ink-jet head, having a plurality of ink-discharge nozzles in a direction substantially orthogonal to a scanning direction, relative to the color-subject material, and discharging ink to the color-subject material by the plurality of ink-discharge nozzles, said apparatus comprising image-signal supplying means for supplying an image signal to the display device, said display device integrally comprising:

light-amount changing means for changing an amount of light displayed; and a color filter for filtering the light displayed, manufactured by the steps of:

calculating a theoretical ink discharge pitch for ink-discharge nozzles of the ink-jet head in accordance with an amount of ink discharged per single discharge of each of those ink-discharge nozzles for which the calculation is performed, in order to make an amount of ink discharged for each pixel constant; and discharging ink such that, in a case where an integer multiple of the theoretical ink discharge pitch coincides with an integer multiple of a minimum moving pitch of an amount of relative movement of the ink-jet head in the scanning direction, ink is discharged at a position corresponding to the integer multiple of the minimum moving pitch, and in a case where an integer multiple of the theoretical ink discharge pitch does not coincide with an integer multiple of the minimum moving pitch of the amount of relative movement of the ink-jet head in the scanning direction, ink is discharged at a position corresponding to a closest integer multiple of the minimum moving pitch.

* * * * *

UNITED STATES PATENT AND TRADEMARK OFFICE

CERTIFICATE OF CORRECTION

PATENT NO. : 6,386,700 B1
DATED : May 14, 2002
INVENTOR(S) : Makoto Akahira

It is certified that error appears in the above-identified patent and that said Letters Patent is hereby corrected as shown below:

Column 2,
Lines 33 and 57, “with” should be deleted.

Column 3,
Lines 14 and 40, “with” should be deleted.
Line 15, “nozzles,” should read -- nozzles, the apparatus comprising image-signal supplying means for supplying an image signal to the display device, --;
Line 31, “kd=nd,” should read -- KD=nd --; and Column 4,
Lines 2, 27 and 54, “with” should be deleted.

Column 5,
Line 17, “with” should be deleted.

Column 7,
Line 32, “colors,” should read -- colors; --.

Column 9,
Line 62, “have” should read -- has --.

Column 10,
Line 42, “case” should read -- the case --.

Column 13,
Line 18, “whereby” should read -- thereby --.

Column 14,
Line 14, “charge” should read -- charged --; and
Lines 19, 26 and 60, “with” should be deleted.

Column 15,
Line 19, “with” should be deleted.

Column 16,
Line 25, “is” should read -- are --; and
Line 64, “whereby” should read -- thereby --.

UNITED STATES PATENT AND TRADEMARK OFFICE

CERTIFICATE OF CORRECTION

PATENT NO. : 6,386,700 B1
DATED : May 14, 2002
INVENTOR(S) : Makoto Akahira

It is certified that error appears in the above-identified patent and that said Letters Patent is hereby corrected as shown below:

Column 18,
Line 34, “whereby” should read -- thereby --; and
Line 67, “kd=nd” should read -- KD=nd --, and “kd” should read -- KD --.

Column 20,
Line 4, “kd=nd” should read -- KD=nd --.

Column 21,
Line 14, “each” should read -- each of --.

Signed and Sealed this

Twenty-ninth Day of April, 2003

JAMES E. ROGAN
*Director of the United States Patent and Trademark Office*